US005190855A

United States Patent [19]

Toya et al.

[11] Patent Number: 5,190,855

[45] Date of Patent: Mar. 2, 1993

[54] SILVER HALIDE PHOTOGRAPHIC MATERIAL AND METHOD FOR PROCESSING THE SAME

[75] Inventors: Ichizo Toya; Rikio Inoue; Tadashi Ito, all of Kanagawa, Japan

[73] Assignee: Fuji Photo Film Co., Ltd., Kanagawa, Japan

[21] Appl. No.: 660,834

[22] Filed: Feb. 26, 1991

[30] Foreign Application Priority Data

Feb. 26, 1990 [JP] Japan ..... 2-45232
Apr. 4, 1990 [JP] Japan ..... 2-89379

[51] Int. Cl.[5] ..... G03C 1/09

[52] U.S. Cl. ..... 430/599; 430/567; 430/600; 430/603; 430/604

[58] Field of Search ..... 430/567, 599, 600, 603, 430/604, 264

[56] References Cited

U.S. PATENT DOCUMENTS 4,814,264 3/1989 Kishida et al. ..... 430/567
4,956,257 9/1990 Inoue ..... 430/264
5,079,138 1/1992 Takada ..... 430/567

*Primary Examiner*—Charles L. Bowers, Jr.
*Assistant Examiner*—Janet C. Baxter
*Attorney, Agent, or Firm*—Sughrue, Mion, Zinn Macpeak & Seas

[57] ABSTRACT

A silver halide light-sensitive material comprising a support having thereon at least one negative silver halide emulsion layer is disclosed, in which a coating weight of the total binder on one side of the support is not more than 4.2 g/m$^2$ and silver halide grains in the emulsion layer have been subjected to reduction sensitization. The light-sensitive material has improved pressure resistance while exhibiting high sensitivity and suitability for ultra-rapid processing.

6 Claims, No Drawings

SILVER HALIDE PHOTOGRAPHIC MATERIAL AND METHOD FOR PROCESSING THE SAME

FIELD OF THE INVENTION

This invention relates to a silver halide photographic material and, more particularly to a silver halide photographic material for medical use which is resistant against blackening due to scratches while having high sensitivity and suitability for ultra-rapid processing.

BACKGROUND OF THE INVENTION

In general, photographic materials having a silver halide emulsion layer are subject to various outside pressure. For example, negative films for general photography are apt to be bent on rolling in a cartridge or loading into a camera or pulled or rubbed with a carriage part of a camera on feeding. Sheet films such as printing films and direct radiographic films for medical use are often bent on handling with hands. When handled in daylight conveying equipment or high-speed changers, photographic materials are brought into contact with metallic or rubber parts with strong force. All kinds of photographic materials receive great pressure on cutting and fabricating.

Pressure thus applied to a photographic light-sensitive material is transmitted to silver halide grains through gelatin, a binder for silver halide grains, or other high-molecular weight substances as a mediator. It is known that pressure application to silver halide grains causes blackening irrespective of exposure amount or desensitization. For the details, reference can be made, e.g., to K. B. Mather, *J. Opt. Soc. Am.*, Vol. 38, p. 1054 (1948), P. Faelens and P. de Smet, *Sco. et Ind. Photo.*, Vol. 25 No. 5, p. 178 (1954), and P. Faelens, *J. Photo. Sci.*, Vol. 2, p. 105 (1954).

It has therefore been demanded to provide a photographic light-sensitive material whose photographic performance is unaffected by pressure.

On the other hand, high-temperature rapid processing of photographic materials has been rapidly spread, and a time required for various light-sensitive materials to be processed in an automatic developing machine has been greatly reduced. Particularly in ultra-rapid processing, efforts have been made to further raise a drying speed in an automatic developing machine.

Speed-up of drying is generally achieved by adding a sufficient amount of a hardening agent to a light-sensitive material so as to reduce a water content before starting drying in an automatic developing machine. Though successful in increasing a drying speed, this means is attended by many disadvantages. That is, enhanced film hardening results in reduction in sensitivity which leads to retardation of development, reduction in covering power even when tabular grains having a high aspect ratio are used, worsening of color remaining, retardation of fixing of silver halide grains, increase of hypo remaining in a processed light-sensitive material, and the like.

Reduction in water content before starting drying can also be achieved by decreasing hydrophilic substances in a light-sensitive material, i.e., gelatin, synthetic high polymers, and hydrophilic low-molecular weight substances. However, a decrease of these hydrophilic substances means a decrease of a ratio of a binder to silver halide grains, which often causes sensitization or desensitization on scratching or bending during handling before development processing particularly in using tabular grains of high aspect ratio. Hence, without any means to improve pressure resistance, it has been difficult to obtain improved drying properties by decreasing a binder.

On the other hand, there has been a long and constant demand for an emulsion having higher photographic speed. An emulsion of high photographic speed makes it feasible to take a photograph without flashlight even at night and to take a photograph of a fast-moving subject at a high shutter speed. When applied to radiography, it would reduce an X-ray exposure dose to minimize the influence of X-ray on human bodies.

It is well known in the art that hydroxyazaindene compounds have a property to suppress chemical ripening with sulfur-containing compounds and are therefore useful as an emulsion stabilizer. They are added to a photographic emulsion for the purpose of stopping a sulfur sensitization reaction and/or preventing fog during preparation, preservation or developing processing. These compounds are also known to increase a photographic speed. For example, British Patent 1,315,755 discloses a method for carrying out sulfur-gold sensitization of a silver halide emulsion, in which an azaindene compound is added to an emulsion before sulfur sensitization and, either simultaneously or thereafter, a monovalent gold complex compound containing sulfur is added, followed by ripening to obtain a silver halide emulsion having higher intrinsic sensitivity than in conventional methods. Further, JP-A-50-63914 (the term "JP-A" as used herein means an "unexamined published Japanese patent application") and German Patent Application (OLS) No. 2,419,798 disclose a method of obtaining increased sensitivity by adding a hydroxytetraazaindene compound to a sulfur-sensitized mono-dispersed emulsion of cubic silver halide grains having a silver bromide content of 80 mol % or more. These references also describe that this method, when applied to silver halide grains other than cubic grains, e.g., octahedral grains and tabular grains which are substantially surrounded by (111) planes, rather results in a reduction in sensitivity or brings about only slight improvement in sensitivity, if any. Further, JP-A-51-77223 teaches that addition of a certain hydroxytetraazaindene compound to a sulfur-sensitized silver halide emulsion whose mean grain size does not exceed 0.5 μm brings about an increase in sensitivity. However, a hydroxytetraazaindene compound has been commonly added as an emulsion stabilizer after chemical ripening irrespective of whether or not the effect of increasing sensitivity may be obtained with or without recognition of that effect. Therefore, the methods disclosed in JP-A-50-63914 and JP-A-51-77223 are not expected as novel techniques for increasing sensitivity.

JP-A-58-126526 proposes a method for preparing a photographic emulsion having a high sensitivity and markedly low fog, in which chemical sensitization of octahedral or tetradecahedral silver halide grains is carried out in the presence of an azaindene compound. Further, JP-A-2-68539 discloses a method for preparing a high sensitivity and low fog emulsion, in which chemical sensitization of tabular grains having an aspect ratio of 3 or more is carried out in the presence of a sensitizing dye and an azaindene compound. Further, it is known that tabular grains are superior to spherical grains for use in X-ray films in view of their higher covering power (optical density per unit silver amount) and higher susceptibility to color sensitization.

On the other hand, there is an unfavorable correlation between photosensitivity and pressure sensitivity. That is, as photosensitivity increases, pressure sensitivity also increases. Moreover, a sensitizing dye promotes the property of silver halide grains to cause fog on application of pressure. In other words, if a large quantity of a sensitizing dye is used for color sensitization in an attempt to increase light absorption and to increase sensitivity, it follows that blackening on pressure application is remarkably emphasized. As a means to be taken against such a disadvantage, it is known to incorporate a plasticizer for polymers or emulsions or to reduce a silver halide/gelatin ratio to thereby prevent applied pressure from reaching silver halide grains.

Known plasticizers include heterocyclic compounds as disclosed in British Patent 738,618, alkyl phthalates as disclosed in British Patent 738,637, alkyl esters as described in British Patent 738,639, polyhydric alcohols as disclosed in U.S. Pat. No. 2,960,404, carboxyalkyl cellulose as disclosed in U.S. Pat. No. 3,121,060, paraffin and carboxylic acid salts as disclosed in JP-A-49-5017, and alkyl acrylates and organic acids as disclosed in JP-B-53-28086 (the term "JP-B" as used herein means an "examined published Japanese patent application").

Since addition of a plasticizer causes a reduction in mechanical strength of an emulsion layer, there is a limit in the used amount of a plasticizer. Further, an increase of gelatin results in retardation of development and reduction in sensitivity. Accordingly, sufficient effects on improving pressure characteristics can hardly be obtained by either of the above-described means.

In general, silver halide grains having a cubic or octahedral crystal form or a potato-like spherical form are less liable to deformation under an outer force because of their shape and have therefore lower pressure sensitivity than tabular grains having a large projected area diameter/thickness ratio. Owing to this advantage, as far as the above-mentioned means for improving pressure characteristics are applied to these grains, some improvements on pressure characteristics could be reached to not a sufficient degree but to a fairly satisfactory level.

Turning now to tabular grains, they have a merit to provide high optical density with a reduced silver amount because of their high covering power per unit area as described in U.S. Pat. Nos. 4,434,226, 4,439,520, and 4,425,425. In addition, they have a large surface area per unit volume and are accordingly capable of adsorbing a larger quantity of a sensitizing dye in spectral sensitization, thus exhibiting higher light capturing ability. Such an advantage can be made best use of by using a sensitizing dye in an amount of 60% or more, preferably 80% or more, and more preferably 100% or more, of a saturation adsorption. As previously stated, however, pressure sensitivity increases with the amount of a sensitizer. Besides, the shape of tabular grains makes them liable to deformation on application of an outer force. For these reasons, the above-described means cannot achieve a satisfactory improvement in pressure characteristics with tabular grains.

JP-A-64-72141 suggests to reduce pressure blackening by adding a polyhydroxybenzene compound to tabular grains. Since this method is accompanied by a reduction in sensitivity, sufficient improvement cannot be reached when high sensitivity is required.

Hence, it is essential to develop a technique for improving pressure resistance of a light-sensitive material which is required to have high sensitivity and suitability for ultra-rapid processing.

In particular, in the field of radiographic materials for medical use including X-ray films, rapid processing has great advantage that quick completion of development processing would permit of a timely medical treatment. A number of studies have thus been made on rapid development processing of X-ray films.

X-ray films have conventionally been processed in a dry-to-dry time (from the beginning of development processing to the end of drying processing) of about 90 seconds. With the developments of rapid processing, the dry-to-dry time has recently been reduced to about 45 seconds. In order to sufficiently agree with the latest medical advancement, there has been a need for further speed-up of processing. For example, ultra-rapid development processing requiring a dry-to-dry time of not more than 30 seconds is desired.

If conventional light-sensitive materials are subjected to ultra-rapid processing in a dry-to-dry time of 30 seconds, there have arisen various problems: for example, a processed light-sensitive material cannot be sufficiently dried; where a binder is reduced to improve drying properties, unevenness of development results; and photographic properties are largely varied on pressure application. In order to overcome development unevenness and to improve pressure resistance while improving drying properties by reducing a binder, there has been no means but to reduce photographic sensitivity.

It has been demanded to develop a light-sensitive material which exhibits sufficient performance properties even when processed in a dry-to-dry time of not more than 30 seconds.

SUMMARY OF THE INVENTION

An object of the present invention is to provide a silver halide light-sensitive material having resistance against blackening due to scratches during handling, yet having high sensitivity and suitability for ultra-rapid processing.

Another object of the present invention is to provide a silver halide light-sensitive material which is suited for rapid processing with a dry-to-dry time of not more than 30 seconds and to provide a method for processing such a light-sensitive material.

It has now been found that the above objects of the present invention are accomplished by a silver halide light-sensitive material comprising a support having thereon at least one negative silver halide emulsion layer containing a binder, in which a coating weight of the total binder on one side of the support is not more than 4.2 g/m$^2$ and silver halide grains in said emulsion layer have been subjected to reduction sensitization.

DETAILED DESCRIPTION OF THE INVENTION

One of the features of the present invention resides in use of a small amount of binder in the light-sensitive material. A coating weight of the whole binder on one side of the support is not more than 4.2 g/m$^2$, and preferably from 2.5 to 4.1 g/cm$^2$.

The term "binder" as used herein means hydrophilic polymers generally having a solubility of at least 0.05 g, and preferably at least 0.1 g, in 100 g of water at 20° C., which hydrophilic polymers form the hydrophilic colloids of at least one hydrophilic colloid layer of the light-sensitive material of the present invention. Gelatin is the most preferred binder. Other hydrophilic polymers are also usable, including proteins (e.g., gelatin derivatives, graft polymers of gelatin with other high polymers, albumin, and casein), cellulose derivatives (e.g., hydroxyethyl cellulose, carboxymethyl cellulose, and cellulose sulfate), sugar derivatives (e.g., sodium alginate, dextran, and starch derivatives), and a wide variety of synthetic hydrophilic high-molecular weight homopolymers (e.g., polyvinyl alcohol, poly-N-vinylpyrrolidone, polyacrylic acid, polymethacrylic acid, polyacrylamide, polyvinylimidazole, and polyvinylpyrazole) or copolymers comprising monomers constituting these homopolymers.

Gelatin species which can be used include lime-processed gelatin, acid-processed gelatin, and enzyme-processed gelatin. Hydrolysis products or enzymatic decomposition products of gelatin are useful as well.

It is preferable to use gelatin in combination with dextran or polyacrylamide having a number average molecular weight of from 5,000 to 100,000. The methods described in JP-A-63-68837 and JP-A-63-149641 are effective in the present invention.

Another feature of the present invention resides in use of a silver halide emulsion which has been subjected to reduction sensitization in the preparation thereof.

A process for preparing a silver halide emulsion is divided into grain formation, desalting, chemical sensitization, coating, and the like. Grain formation is further divided into nucleation, ripening, growth, etc. The order of these stages is not strictly specified, and some of them may be conducted in a reversed order, or some of them may be conducted repeatedly. The phrase "reduction sensitization in the preparation of an emulsion" as stated above basically means that reduction sensitization may be performed in any of the stages of emulsion preparation before coating. Namely, reduction sensitization can be carried out during nucleation in the initial stage of grain formation, during physical ripening, during grain growth, prior to chemical sensitization, or after chemical sensitization. When gold sensitization is conducted in combination, it is preferably preceded by reduction sensitization so as not to cause unfavorable fog. In a most preferred embodiment, reduction sensitization is effected during grain growth. The terminology "during grain growth" as used herein means to embrace an embodiment in which silver halide grains are subjected to reduction sensitization while they are growing by physical ripening or by addition of a water-soluble silver salt and a water-soluble alkali halide and an embodiment in which silver halide grains are subjected to reduction sensitization while temporarily suspending their growth and, after reduction sensitization, allowed to further grow.

Reduction sensitization according to the present invention can be carried out by a method comprising adding a known reducing agent to a silver halide emulsion, a method called "silver ripening" which comprises allowing silver halide grains to grow or ripen in a low pAg atmosphere, i.e., at a pAg of from 1 to 7, a method called "high pH ripening" which comprises allowing silver halide grains to grow or ripen in a high pH atmosphere, i.e., at a pH of from 8 to 11, or a combination of two or more of these methods.

The method of adding a reducing sensitizer is preferred for fine control of reduction sensitization level being achieved.

Reducing sensitizers which can be used in the present invention are selected from known compounds, such as stannous salts, amines, polyamines, hydrazine derivatives, formamidine sulfinic acid (thiourea dioxide), silane compounds, ascorbic acid derivatives, and borane compounds, with ascorbic acid, thiourea dioxide, and dimethylamine-borane being preferred. Two or more reducing sensitizers may be used in combination.

The amount of the reducing sensitizer to be added is appropriately selected depending on conditions of emulsion preparation. A suitable amount ranges from $1\times10^{-8}$ to $1\times10^{-3}$ mol, and preferably from $1\times10^{-7}$ to $1\times10^{-5}$ mol, per mol of silver halide.

The reducing sensitizer is added to silver halide grains during grain formation or before or after chemical sensitization in the form of a solution in water or other solvents, such as alcohols, glycols, ketones, esters, and amides. While it may be added in any stage of emulsion preparation as stated above, it is preferably added during and/or after grain formation prior to chemical sensitization. In the case of adding during grain formation, the reducing sensitizer may be previously put in a reaction vessel, but preferably in an appropriate stage during grain formation. It is possible to previously add a reducing sensitizer to an aqueous solution of a water-soluble silver salt or a water-soluble alkali halide to be used for grain formation. It is also preferable to feed a solution of a reducing sensitizer to silver halide grains while growing either in several divided portions or in a continuous manner for an extended period of time.

In the present invention, it is preferable to use a thiosulfonic acid compound disclosed in Japanese Patent Application Nos. Sho-63-159888 and Sho-63-258787 in combination with reduction sensitization.

Reduction sensitization may be combined with other chemical sensitization techniques, such as sulfur sensitization, selenium sensitization, gold sensitization, and the like.

Sulfur sensitizers which can be used in the present invention are selected from known compounds, e.g., thiosulfates, allylthiocarbamide thiourea, allyl isothiocyanate, cystine, p-toluenethiosulfonate, and rhodanine. In addition, sulfur sensitizers described in U.S. Pat. Nos. 1,574,944, 2,410,689, 2,278,947, 2,728,668, 3,501,313, and 3,656,955, German Patent 1,422,869, British Patent 1,403,980, and JP-A-55-45016 are also useful. The sulfur sensitizer is added in an amount enough to effectively increase sensitivity of an emulsion. Such an amount varies in a considerably broad range depending on various conditions, such as the amount of a hydroxyazaindene compound added (hereinafter described), a pH condition, a temperature condition, and the size of silver halide grains, but it is generally from about $1\times10^{-5}$ to about $1\times10^{-1}$ mol per mol of silver halide.

Sulfur sensitization may be replaced by selenium sensitization. Useful selenium sensitizers include aliphatic isoselenocyanates (e.g., allyl isoselenocyanate), selenoureas, selenoketones, selenoamides, selenocarboxylic acids and esters thereof, selenophosphates, and selenides (e.g., diethyl selenide and diethyl diselenide). Specific examples of these selenium sensitizers are described in U.S. Pat. Nos. 1,574,944, 1,602,592, and 1,623,499. While the amount of a selenium sensitizer to be added widely varies similarly to sulfur sensitizers, it is generally from about $1\times10^{-9}$ to about $1\times10^{-6}$ mol per mol of silver halide.

Gold sensitizers to be used for gold sensitization include various kinds of gold compounds having an oxidation number of either +1 or +3. Typical examples of useful gold sensitizers are chloroauric acid salts, e.g., potassium chloroaurate, auric trichloride, potassium auric thiocyanate, potassium rhodoaurate, tetracyanoauric acid, ammonium aurothiocyanate, and pyridyl trichlorogold.

When sulfur sensitization or selenium sensitization is combined with gold sensitization, gold specks and silver sulfide-gold specks or silver selenide-gold specks are formed as sensitivity specks. The number of the sensitivity specks and, particularly the composition of silver sulfide-gold specks or silver selenide-gold specks have great influences on electron trapping properties or developing properties. Namely, a ratio of a gold sensitizer to a sulfur sensitizer or a selenium sensitizer greatly influences sensitization effects. The amounts of these sensitizers to be used should be decided so as to effectively increase sensitivity of an emulsion in view of ripening conditions. A ratio of a gold sensitizer to a sulfur or selenium sensitizer is preferably such that the ratio of the number of gold atoms to that of sulfur atoms or selenium atoms forming silver sulfide or silver selenide ranges from ½ to 1/200.

A gold sensitizer may be added simultaneously with a sulfur or selenium sensitizer or during or after completion of sulfur or selenium sensitization.

In a preferred embodiment of the present invention, silver halide grains are subjected to reduction sensitization, and further subjected to sulfur sensitization or selenium sensitization in combination with gold sensitization in the presence of a nitrogen-containing heterocyclic compound capable of forming a complex with silver. In this case, an emulsion having markedly increased sensitivity with low fog can be prepared as compared with the case where reduction sensitization is merely combined with gold-sulfur sensitization or where gold-sulfur sensitization is conducted in the presence of the nitrogen-containing heterocyclic compound.

Examples of heterocyclic rings in the nitrogen-containing heterocyclic compounds which can be used in the present invention include a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5 -thiadiazole ring, a 1,2,3,4-tetrazole ring, a pyridazine ring, a 1,2,3-triazine ring, a 1,2,4-triazine ring, and a 1,3,5-triazine ring; and condensed rings composed of two or three of these heterocyclic rings, e.g., a triazolotriazole ring, a diazaindene ring, a triazaindene ring, a tetraazaindene ring, and a pentaazaindene ring. Condensed rings composed of a monocyclic heterocyclic ring and an aromatic ring, e.g., a phthalazine ring, a benzimidazole ring, an indazole ring, and a benzothiazole ring, are also useful.

Preferred of the nitrogen-containing heterocyclic compounds are those having an azaindene ring. More preferred are azaindene compounds having a hydroxyl group as a substituent, e.g., hydroxytriazaindene, hydroxytetraazaindene, and hydroxypentaazaindene.

The heterocyclic ring may further have other substituents than a hydroxyl group, e.g., an alkyl group, a substituted alkyl group, an alkylthio group, an amino group, a hydroxyamino group, a alkylamino group, a dialkylamino group, an arylamino group, a carboxyl group, an alkoxycarbonyl group, a halogen atom, and a cyano group.

Specific examples of suitable nitrogen-containing heterocyclic compounds are shown below for illustrative purposes only, and the present invention is not limited thereto.

(1) 2,4-Dihydroxy-6-methyl-1,3a,7-triazaindene
(2) 2,5-Dimethyl-7-hydroxy-1,4,7a-triazaindene
(3) 5-Amino-7-hydroxy-2-methyl-1,4,7a-triazaindene
(4) 4-Hydroxy-6-methyl-1,3,3a,7-tetraazaindene
(5) 4-Hydroxy-1,3,3a,7-tetraazaindene
(6) 4-Hydroxy-6-phenyl-1,3,3a,7-tetraazaindene
(7) 4-Methyl-6-hydroxy-1,3,3a,7-tetraazaindene
(8) 2,6-Dimethyl-4-hydroxy-1,3,3a,7-tetraazaindene
(9) 4-Hydroxy-5-ethyl-6-methyl-1,3,3a,7-tetraazaindene
(10) 2,6-Dimethyl-4-hydroxy-5-ethyl-1,3,3a,7-tetraazaindene
(11) 4-Hydroxy-5,6-dimethyl-1,3,3a,7-tetraazaindene
(12) 2,5,6-Trimethyl-4-hydroxy-1,3,3a,7-tetraazaindene
(13) 2-Methyl-4-hydroxy-6-phenyl-1,3,3a,7-tetraazaindene
(14) 4-Hydroxy-6-methyl-1,2,3a,7-tetraazaindene
(15) 4-Hydroxy-6-ethyl-1,2,3a,7-tetraazaindene
(16) 4-Hydroxy-6-phenyl-1,2,3a,7-tetraazaindene
(17) 4-Hydroxy-1,2,3a,7-tetraazaindene
(18) 4-Methyl-6-hydroxy-1,2,3a,7-tetraazaindene
(19) 7-Hydroxy-5-methyl-1,2,3,4,6-pentaazaindene
(20) 5-Hydroxy-7-methyl-1,2,3,4,6-pentaazaindene
(21) 5,7-Dihydroxy-1,2,3,4,6-pentaazaindene
(22) 7-Hydroxy-5-methyl-2-phenyl-1,2,3,4,6-pentaazaindene
(23) 5-Dimethylamino-7-hydroxy-2-phenyl-1,2,3,4,6-pentaazaindene The amount of the nitrogen-containing heterocyclic compound to be added varies depending on the size and composition of silver halide grains, ripening conditions, and the like. The amount can also be adjusted by controlling an adsorption equilibrium with pH and/or temperature changes during ripening. Two or more of the nitrogen-containing heterocyclic compounds may be used in combination in a total amount falling within the predetermined range. The amount of the nitrogen-containing heterocyclic compound is generally in an amount of from $1\times10^{-5}$ to $1\times10^{-1}$ mol, preferably from $8\times10^{-5}$ to $1\times10^{-2}$ mol, per mol of silver halide.

The nitrogen-containing heterocyclic compound is added to an emulsion as a solution in an appropriate solvent having no adverse influences on the emulsion, such as water and aqueous alkali solutions. The stage of addition is preferably before or simultaneously with the addition of a sulfur sensitizer or a selenium sensitizer for chemical ripening. The addition of a gold sensitizer may be during or after completion of the sulfur or selenium sensitization.

In the present invention, a sensitizing dye is preferably used to obtain favorable results.

Sensitizing dyes may be added in any stage of emulsion preparation and is preferably added at the time of chemical sensitization for obtaining high sensitivity.

Examples of useful sensitizing dyes include cyanine dyes, merocyanine dyes, complex cyanine dyes, complex merocyanine dyes, holopolar cyanine dyes, styryl dyes, hemicyanine dyes, oxonol dyes, and hemioxonol dyes.

Specific examples of useful sensitizing dyes are described, e.g., in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525, and Belgian Patent 691,807.

The sensitizing dyes are preferably added in an amount of 80% or more, and particularly 100% or more and less than 200%, of a saturation adsorption onto silver halide grains, which corresponds to 300 mg or more and less than 1500 mg, and particularly 400 mg or more and less than 1000 mg, per mol of silver halide.

The terminology "saturation adsorption" as used herein means a value obtained by centrifuging an emulsion in a centrifugal separator and determining dye absorption of the supernatant liquor.

Specific examples of effective sensitizing dyes are shown below.

(1)

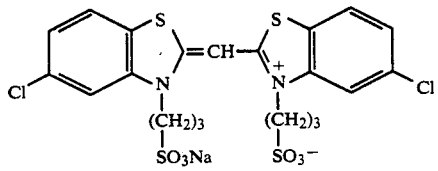

(2)

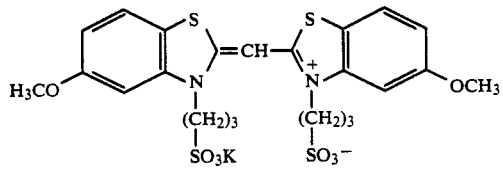

(3)

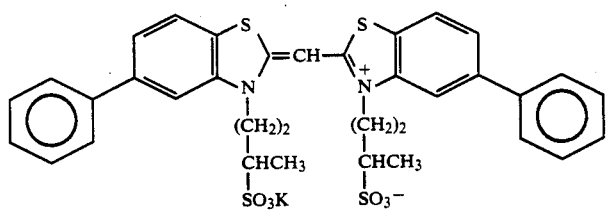

(4)

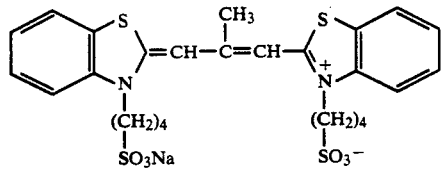

(5)

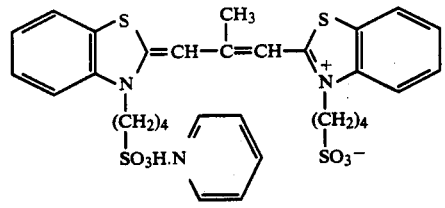

(6)

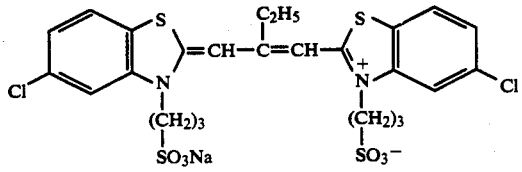

(7)

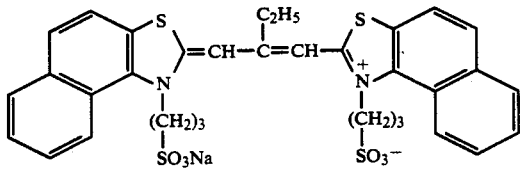

-continued
(8)
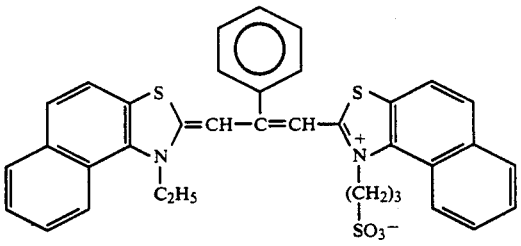
(9)
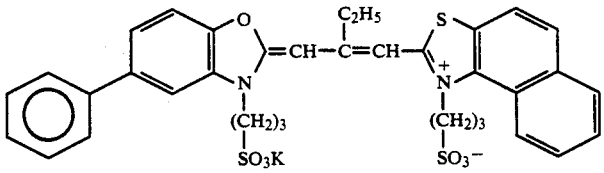
(10)
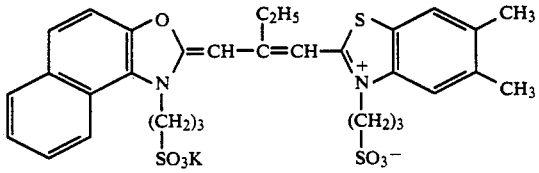
(11)
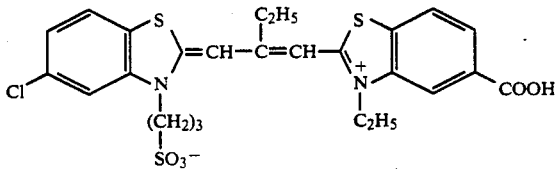
(12)
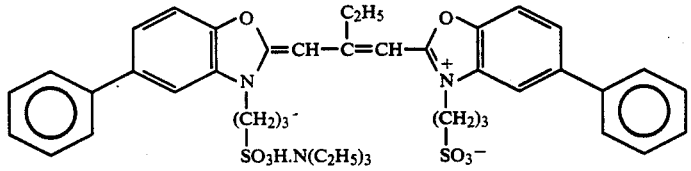
(13)
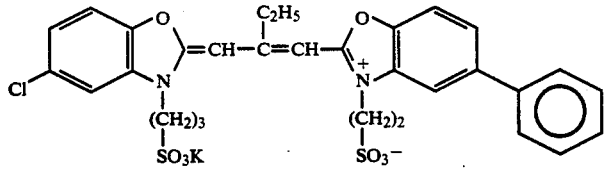
(14)
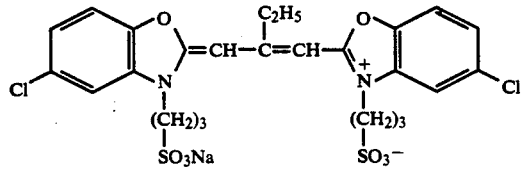
(15)
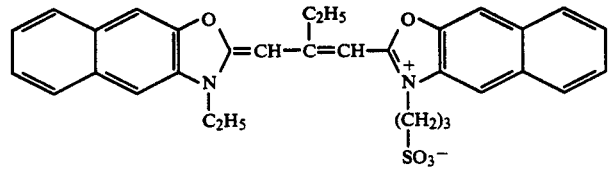

-continued
(16)
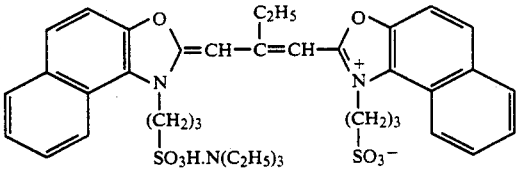
(17)
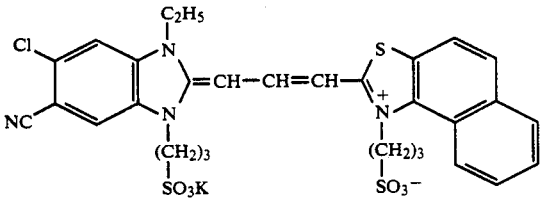
(18)
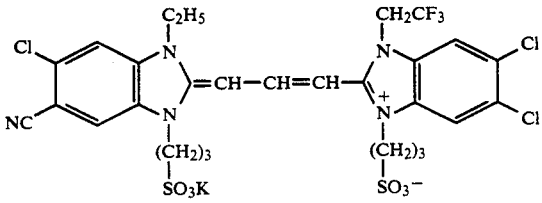
(19)
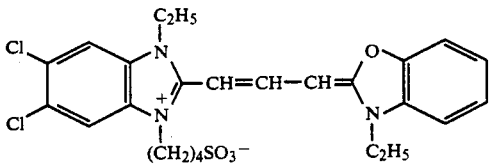
(20)
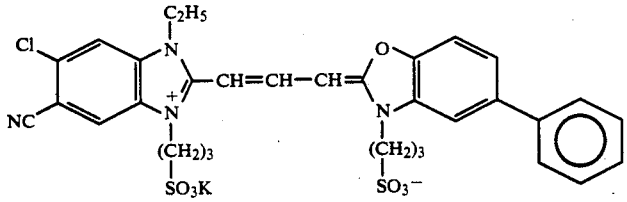
(21)
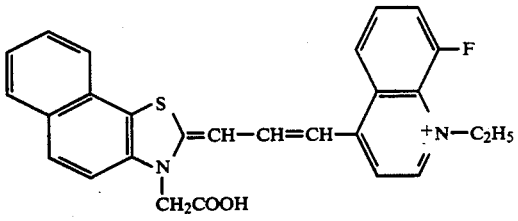
(22)
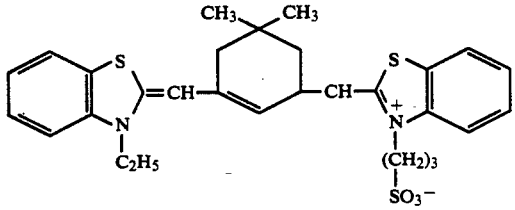
(23)
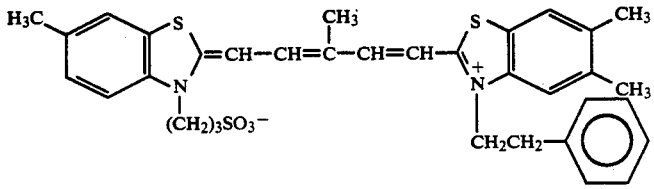

-continued
(24)
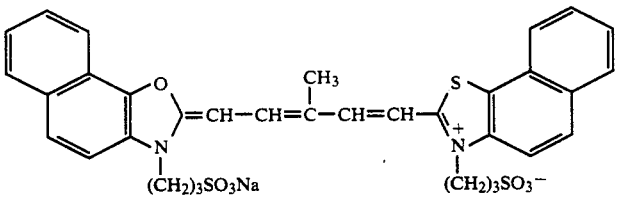
(25)
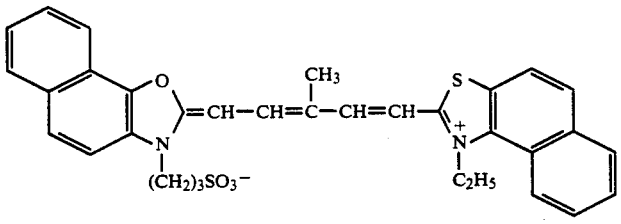
(26)
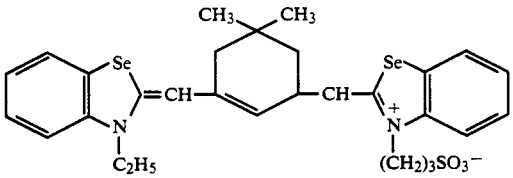
(27)
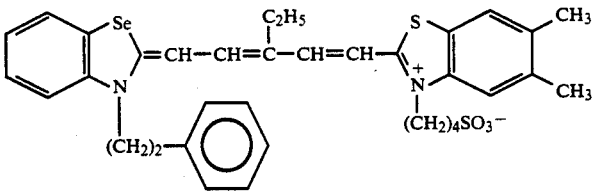
(28)
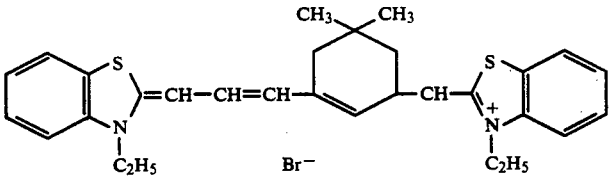
(29)
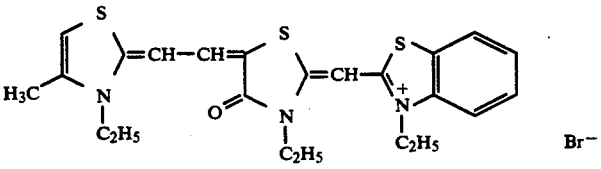
(30)
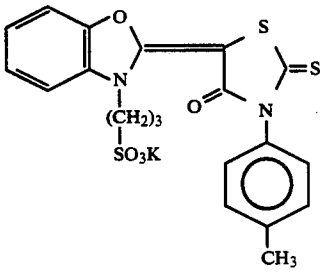

-continued
(31)
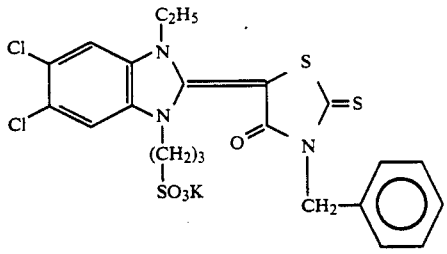
(32)
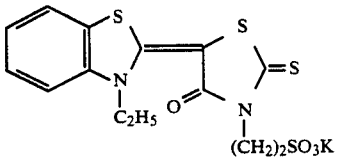
(33)
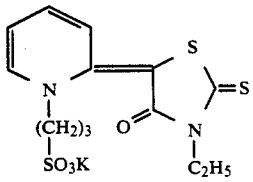
(34)
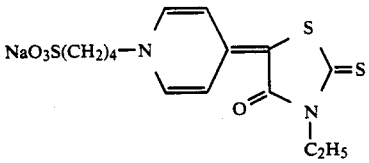
(35)
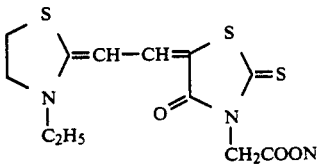
(36)
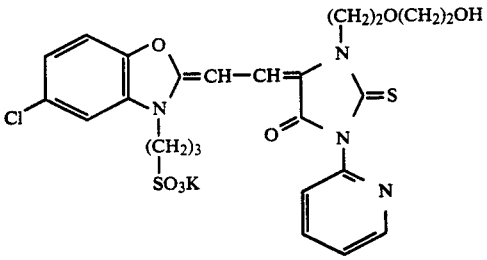
(37)
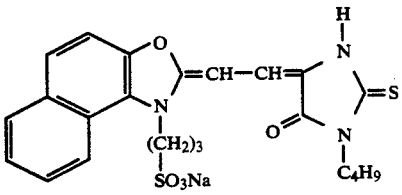
(38)
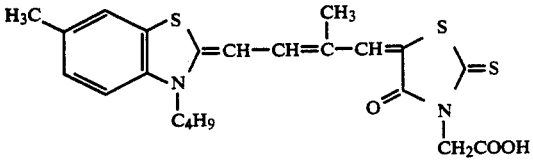

-continued (39)

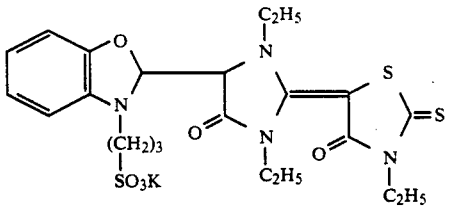

(40)

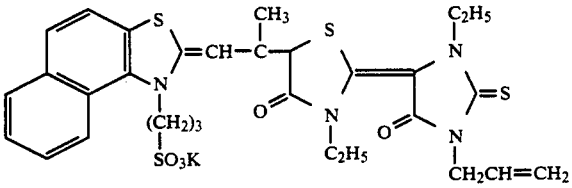

(41)

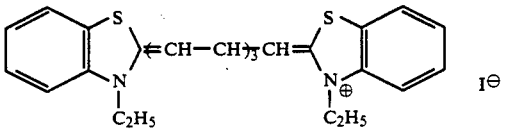

(42)

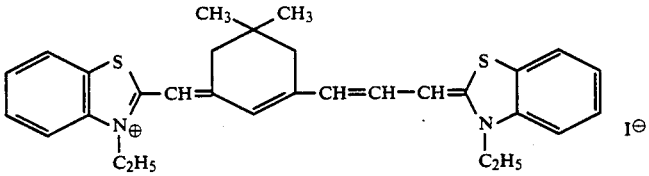

(43)

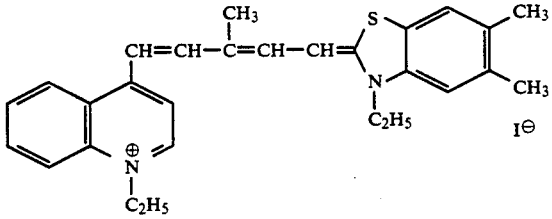

(44)

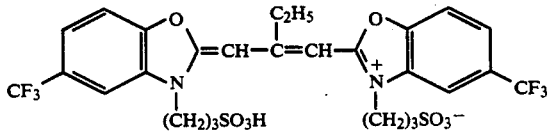

Among the foregoing sensitizing dyes, particularly preferred are cyanine dyes.

Where the present invention is applied to radiographic materials for medical use, trimethine dyes, e.g., Compound Nos. (4) to (21) and (44), are preferred from the standpoint of obtaining high sensitivity.

Silver halide grains which can be preferably used in the present invention are tabular grains, and particularly those having an aspect ratio of 3 or more. The silver halide emulsion layer preferably contains tabular grains having an aspect ratio of 3 or more in a proportion of at least 50% based on the total projected area. It is more preferable that the emulsion layer contains at least 70% of tabular grains having an aspect ratio of from 3 to 10, and particularly from 4 to 8.

The terminology "aspect ratio" as used herein means a thickness to diameter ratio of silver halide grain, the diameter being defined as a diameter of circle having the same area as the projected area of the grain, which is herein sometimes referred to as "a projected area diameter".

Processes for preparing tabular silver halide grain emulsions are described, e.g., Cugnac and Chateau, *Sci. et Ind. Photo.*, Vol. 33, No. 2, pp. 121–125, "Evolution of the Morphology of Silver Bromide Crystals During Physical Ripening" (1962); G. F. Duffin, *Photographic Emulsion Chemistry*, pp. 66–72, Focal Press, New York (1966); and A. P. H. Trivelli and W. F. Smith, *Photographic Journal*, Vol. 80, p. 285 (1940). In particular, these emulsions can be prepared with ease by referring to the processes described in JP-A-58-127921, JP-A-58-113972, JP-A-58-113928, and U.S. Pat. No. 4,439,520.

Tabular grain emulsions can also be prepared by a process in which seed crystals containing at least 40% by weight of tabular grains are formed at a relatively low pBr value of 1.3 or less and then allowed to grow while simultaneously feeding a silver salt solution and a halide solution under the equal pBr condition. During the grain growth stage, addition of the silver salt and halide solutions is preferably effected taking care not to form new crystal nuclei.

The size of tabular silver halide grains can be adjusted by controlling the temperature, the kind and amount of the solvent, and the feeding rates of a silver salt solution and a halide solution.

Of the tabular silver halide grains, mono-dispersed hexagonal tabular grains are particularly useful. The details of the structure of mono-dispersed hexagonal tabular grains and of the processes for preparing the same are described in Japanese Patent Application No. Sho-61-299155. In brief, a mono-dispersed hexagonal tabular grain emulsion comprises a medium having dispersed therein silver halide grains, at least 70%, based on the total projected area, of which comprise hexagonal grains having a longest side length to shortest side length ratio of not more than 2 and having two parallel planes as outer surfaces, with mono-dispersion characteristics as having a variation coefficient of grain size distribution (a quotient obtained by dividing a standard deviation of grain size (expressed in terms of diameter of circle equivalent to projected area) by a mean grain size) of not more than 20%. The individual hexagonal tabular grains may have a homogeneous crystal structure but preferably have a heterogeneous structure comprising a core and an outer shell differing in halogen composition. The grains may have a layered structure. The grains preferably contain reduction sensitization silver specks.

The tabular grains to be used in the present invention comprise those grains having an average aspect ratio of 3.0 or more in a proportion of at least 50% of the total projected area. All the grains having a thickness of 0.3 μm or less preferably have an aspect ratio of 3 or more, and more preferably of from 5 to 10.

The tabular grains preferably have a mean projected area diameter of from 0.3 to 2.0 μm, and more preferably of from 0.5 to 1.6 μm. The distance between two parallel planes (i.e., grain thickness) is preferably from 0.05 to 0.3 μm, and more preferably from 0.1 to 0.25 μm.

Silver halide grains of so-called halogen-converted type (conversion type) as described in British Patent 635,841 and U.S. Pat. No. 3,622,318 are especially advantageous in the present invention because conversion of the surface of the tabular grains results in the production of a silver halide emulsion having higher sensitivity and enhances effects of the present invention.

Halogen conversion is usually carried out by adding to an emulsion an aqueous solution of a halide which forms a silver halide whose solubility product is smaller than that of the silver halide on the grain surface before halogen conversion. For example, halogen conversion is induced by addition of an aqueous solution of potassium bromide and/or potassium iodide to silver chloride or silver chlorobromide tabular grains, or by addition of an aqueous solution of potassium iodide to silver bromide or silver iodobromide tabular grains. The aqueous solution to be added preferably has a small concentration of not more than 30% by weight, and more preferably not more than 10% by weight. It is preferably added at a feed rate of not more than 1 mol% per minute per mol of silver halide before conversion. During halogen conversion, a sensitizing dye may be present. Fine grains of silver bromide, silver iodobromide or silver iodide may be added in place of a halogen aqueous solution for conversion. The fine silver halide grains to be added preferably have a grain size of not more than 0.2 μm, more preferably not more than 0.1 μm, and most preferably not more than 0.05 μm. The amount of halogen to be converted preferably ranges from 0.1 to 1 mol %, and more preferably from 0.1 to 0.6 mol %, based on the silver halide before conversion.

The method of halogen conversion which can be used in the present invention is not confined to any one of the above-described methods, and an appropriate combination of these methods can be employed according to the purpose. A silver halide composition on the grain surface before halogen conversion preferably has a silver iodide content of not more than 3 mol %, and more preferably not more than 1.0 mol %.

It is particularly effective to carry out the above-described halogen conversion in the presence of a silver halide solvent. Suitable silver halide solvents include thioether compounds, thiocyanates, ammonia, and tetra-substituted thiourea, with thioether compounds and thiocyanates being particularly effective. A thiocyanate is preferably used in an amount of from 0.5 to 5 g per mol of silver halide, and a thioether compound is preferably used in an amount of from 0.2 to 3 g per mol of silver halide.

In the preparation of silver halide emulsions, a compound capable of releasing an inhibitor at the time of development as described in JP-A-61-230135 and Japanese Patent Application No. Sho-61-169499 may be used in combination.

During grain formation or physical ripening, a cadmium salt, a zinc salt, a lead salt, a thallium salt, an iridium salt or a complex salt thereof, a rhodium salt or a complex salt thereof, an iron salt or a complex salt thereof, etc. may be present in the system for the preparation of a silver halide emulsion.

During grain formation, a so-called silver halide solvent, e.g., thiocyanates, ammonia, thioether compounds, thiazolidinethione, and tetra-substituted thiourea, may be present in the system. Among them, thiocyanates, ammonia, and thioether compounds are preferred.

Tabular grains of apex development initiation type as described in JP-A-63-305343 are extremely useful in the present invention.

For the purpose of preventing fog during preparation, preservation or photographic processing of a light-sensitive material or for stabilizing photographic performance properties, various compounds may be incorporated into a photographic emulsion independently of the above-mentioned nitrogen-containing heterocyclic compound added in the chemical sensitization stage. Such compounds include azoles, such as benzothiazolium salts, nitroimidazoles, nitrobenzimidazoles, chlorobenzimidazoles, bromobenzimidazoles, nitroindazoles, benzotriazoles, and aminotriazoles; mercapto compounds, such as mercaptothiazoles, mercaptobenzothiazoles, mercaptobenzimidazoles, mercaptothiadiazoles, mercaptotetrazoles, mercaptopyrimidiens, and mercaptotriazines; thioketo compounds, such as oxazolinethione; azaindenes, such as triazaindenes, tetraazaindenes (especially 4-hydroxy-substituted (1,3,3a,7)-tetraazaindenes), and pentaazaindenes; benzenethiosulfonic acids, benzenesulfinic acids, benzenesulfonic acid amides, and many other compounds known as antifoggants or stabilizers. In particular, nitron and its derivatives described in JP-A-60-76743 and JP-A-60-87322, mercapto compounds described in JP-A-60-80839, heterocyclic compounds described in JP-A-57-164735, and silver complex salts with heterocyclic compounds (e.g., 1-phenyl-5-mercaptotetrazole silver) are preferred.

In another preferred embodiment for accomplishing the objects of the present invention, the silver halide emulsion layer of the present invention substantially contains at least one of compounds represented by formula (I):

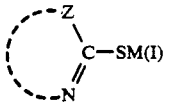

wherein Z represents an atomic group necessary to form a 5- or 6-membered ring; and M represents a hydrogen atom, an alkali metal, or an ammonium group.

Examples of the 5- or 6-membered ring formed by Z include imidazole, imidazoline, oxazole, oxazoline, thiazole, thiazoline, thiadiazole, oxadiazole, triazole, tetrazole, pyridine, and pyrimidine rings.

M preferably represents a hydrogen atom.

Specific examples of the compounds represented by formula (I) are shown below for illustrative purposes only but not for limitation.

(I-1)

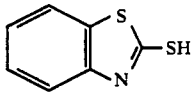

(I-2)

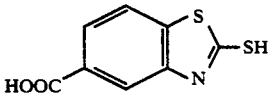

(I-3)

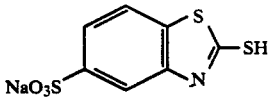

(I-4)

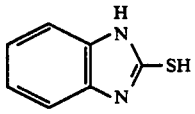

(I-5)

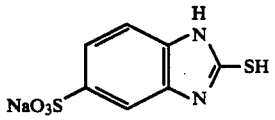

(I-6)

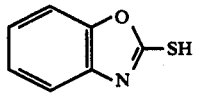

(I-7)

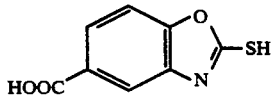

(I-8)

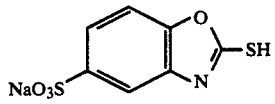

-continued (I-9)

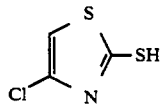

(I-10)

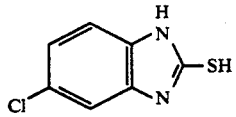

(I-11)

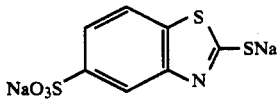

(I-12)

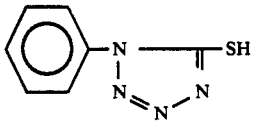

(I-13)

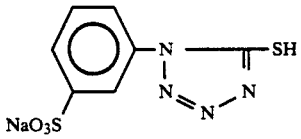

(I-14)

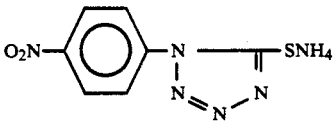

(I-15)

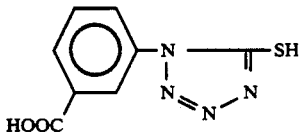

(I-16)

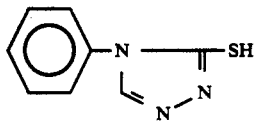

(I-17)

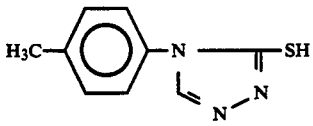

(I-20)

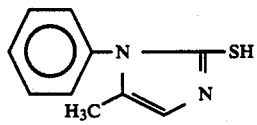

(I-21)

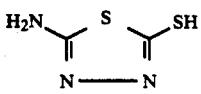

(I-22)

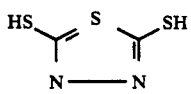

-continued (I-23)

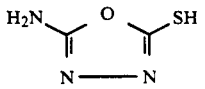

(I-24)

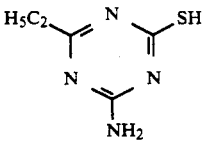

(I-25)

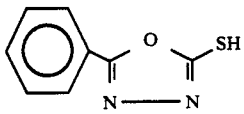

(I-26)

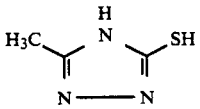

(I-27)

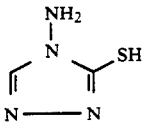

(I-28)

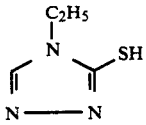

(I-29)

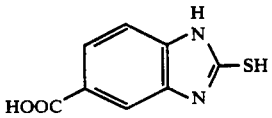

The compound of formula (I) is used preferably in an amount of from $1\times10^{-6}$ to $1\times10^{-2}$ mol, and more preferably from $1\times10^{-5}$ to $1\times10^{-3}$ mol, per mol of silver in an emulsion layer.

The compound of formula (I) exerts its effect when it is substantially present in a tabular silver halide emulsion layer. That is, the compound may be added to a layer other than a tabular silver halide emulsion layer, for example, a surface protective layer, as long as the compound added is diffused into an emulsion layer and exists therein in the above-specified amount.

In the present invention, it is preferable to further use a polyhydroxyl-substituted benzene (polyhydroxybenzene) compound in combination. Typical but non-limiting examples of polyhydroxybenzene compound which can be preferably used in the present invention are shown below.

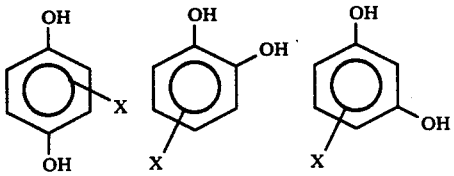

-continued

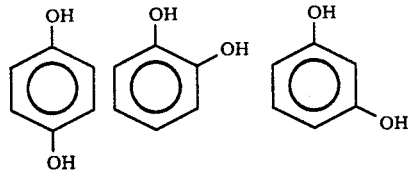

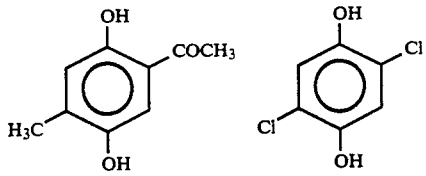

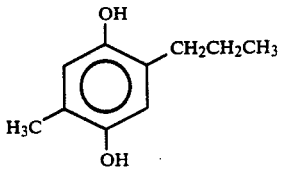

wherein X preferably represents —H, —OH,

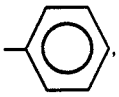

—Cl, —Br, —COOH, $—CH_2CH_2COOH$, $(CH_3)_2CH—$, $CH_3$13, $(CH_3)_3C—$, $—OCH_3$, —CHO, $—SO_3K$, etc. Particularly preferred of these substituents are $—SO_3K$ and —Cl.

Among these polyhydroxybenzene compounds, 1,4-dihydroxybenzene compounds, and particularly

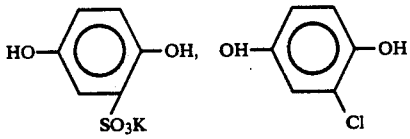

are preferred.

The polyhydroxy compound is added to silver halide emulsion layers or other hydrophilic colloidal layers, and preferably a silver halide emulsion layer. The amount to be added is less than $1\times10^{-1}$ mol, preferably less than $5\times10^{-2}$ mol, and more preferably from $1\times10^{-3}$ to $4\times10^{-2}$ mol, per mol of silver in the light-sensitive material.

The photographic emulsion layers or other hydrophilic colloidal layers of the light-sensitive material according to the present invention may contain various surface active agents as coating aids, antistatic agents, slip agents, emulsion or dispersion aids, anti-block agents, or for improvements of photographic characteristics, for example, for development acceleration, increase of contrast or increase of sensitivity.

Example of surface active agents include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene oxide adducts of silicone), and alkyl esters of saccharides; anionic surface active agents, such as alkylsulfonates, alkylbenzenesulfonates, alkylnaphthalenesulfonates, alkylsulfates, N-acyl-N-alkyltaurines, sulfosuccinic esters, and sulfoalkyl polyoxyethylene alkylphenyl ethers; amphoteric surface active agents, such as alkylbetaines and alkylsulfobetains; and cationic surface active agents, such as aliphatic or aromatic quaternary ammonium salts, pyridinium salts, and imidazolium salts. Preferred of them are anionic surface active agents, e.g., saponin, sodium dodecylbenzenesulfonate, sodium di-2-ethylhexyl-α-sulfosuccinate, sodium p-octylphenoxyethoxyethoxyethanesulfonate, sodium dodecylsulfate, sodium triisopropylnaphthalenesulfonate, and sodium N-methyloleoyltaurine; cationic surface active agents, e.g., dodecyltrimethylammonium chloride, N-oleoyl-N',N',N'-trimethylammoniodiaminopropane bromide and dodecylpyridium chloride; betaines, e.g., N-dodecyl-N,N-dimethylcarboxybetaine and N-oleoyl-N,N-dimethylsulfobutylbetaine; and nonionic surface active agents, e.g., poly(average degree of polymerization n=10)oxyethylene cetyl ether, poly(n=25)oxyethylene p-nonylphenyl ether, and bis(1-poly(n=15)oxyethylene-oxy-2,4-di-t-pentylphenyl)ethane.

For use as an antistatic agent, preferred are fluorine-containing compounds, e.g., potassium perfluorooctanesulfonate, sodium N-propyl-N-perfluorooctanesulfonylglycine, sodium N-propyl-N-perfluorooctanesulfonylaminoethyloxy poly(n=3)oxyethylenebutanesulfonate, N-perfluorooctanesulfonyl-N',N',N'-trimethylammoniodiaminopropane chloride, and N-perfluorodecanoylaminopropyl-N',N'-dimethyl-N'-carboxybetaine; nonionic compounds as described in JP-A-60-80848, JP-A-61-112144, and Japanese Patent Application Nos. Sho-61-13398, and Sho-61-16056; alkali metal nitrates; and conductive tin oxide, zinc oxide or vanadium pentoxide, or antimony-doped complex oxides thereof.

Matting agents which can be used in this invention include fine particles of organic compounds, e.g., polymethyl methacrylate, a methyl methacrylate-methacrylic acid copolymer, and starch, or inorganic compounds, e.g., silica, titanium dioxide, and barium strontium sulfate, each having a particle size of from 1.0 to 10 μm, and preferably from 2 to 5 μm.

In a surface layer of the light-sensitive material, slip agents, e.g., silicone compounds as described in U.S. Pat. Nos. 3,489,576 and 4,047,958, colloidal silica as described in JP-B-56-23139, paraffin waxes, higher fatty acid esters, and starch derivatives, may be added.

Hydrophilic colloidal layers of the light-sensitive material may contain polyols, e.g., trimethylolpropane, pentanediol, butanediol, ethylene glycol, and glycerin, as a plasticizer.

The photographic emulsion layers or light-insensitive hydrophilic colloidal layers can contain organic or inorganic hardening agents. Examples of suitable hardening agents are chromates (e.g., chromium alum), aldehydes (e.g., formaldehyde and glutaraldehyde), N-methylol compounds (e.g., dimethylolurea), dioxane derivatives e.g., 2,3-dihydroxydioxane), active vinyl compounds (e.g., 1,3,5-triacryloyl-hexahydro-s-triazine, bis(vinylsulfonyl)methyl ether, N,N'-methylenebis[β-(vinylsulfonyl)propionamide]), active halogen compounds (e.g., 2,4-dichloro-6-hydroxy-s-triazine), mucohalogenic acids (e.g., mucochloric acid), isoxazoles, dialdehyde starch, and 2-chloro-6-hydroxytriazinylated gelatin, either individually or in combination of two or more thereof. Active vinyl compounds described in JP-A-53-41221, JP-A-53-57257, JP-A-59-162546, and JP-A-60-80846 and active halogen compounds described in U.S. Pat. No. 3,325,287 are especially preferred. N-carbamoylpyridinium salts (e.g., 1-morpholinocarbonyl-3-pyridinio)methanesulfonate), and haloamidinium salts (e.g., 1-(1-chloro-1-pyridinomethylene)pyrrolidinium 2-naphthalenesulfonate) are also useful.

High-molecular weight hardening agents can also be effectively used in the present invention. Examples of suitable high-molecular weight hardening agents include polymers having an aldehyde group, e.g., dialdehyde starch, polyacrolein, and acrolein copolymers described in U.S. Pat. No. 3,396,029; polymers having an epoxy group as described in U.S. Pat. No. 3,623,878; polymers having a dichlorotriazine group as described in U.S. Pat. No. 3,362,827 and *Research Disclosure,* No. 17333 (1978); polymers having an active ester group as described in JP-A-56-66841; and polymers having an active vinyl group or a precursor thereof as described in JP-A-56-142524, U.S. Pat. No. 4,161,407, JP-A-54-65033, and *Research Disclosure,* No. 16725 (1978), with polymers having an active vinyl group or a precursor thereof being preferred. Inter alia, those having an active vinyl group or a precursor thereof bonded to the polymer main chain thereof through a long spacer as described in JP-A-56-142524 are preferred.

Supports which can be used in the present invention preferably include a polyethylene terephthalate film and a cellulose triacetate film.

In order to improve adhesion of a support to hydrophilic colloidal layers, the surface of the support is preferably subjected to a surface treatment, such as a corona discharge, a glow discharge, and ultraviolet irradiation; or a subbing layer comprising a styrene-butadiene type latex or a vinylidene chloride type latex may be provided on the support. A gelatin layer may further be provided on the subbing layer. A subbing layer can be made from an organic solvent containing a polyethylene swelling agent and gelatin. Adhesion of a subbing layer to a hydrophilic colloidal layer may be improved by subjecting the subbing layer to a surface treatment.

For the purpose of absorbing light in specific wavelength region, i.e., controlling spectral composition of light entering into photographic emulsion layers, a photographic emulsion layer or other specific layer may be colored with a dye to provide an antihalation layer, an anti-irradiation layer or a filter layer. Both-sided emulsion films, such as X-ray films for direct radiography, may have such a colored layer for cross-over cut beneath an emulsion layer. Dyes for these purposes include oxonol dyes having a pyrazolone nucleus or a barbituric acid nucleus, azo dyes, azomethine dyes, anthraquinone dyes, allylidene dyes, styryl dyes, triarylmethane dyes, marocyanine dyes, and cyanine dyes.

Typical examples of these dyes are shown below for illustrative purposes only but not for limitation.

(a)
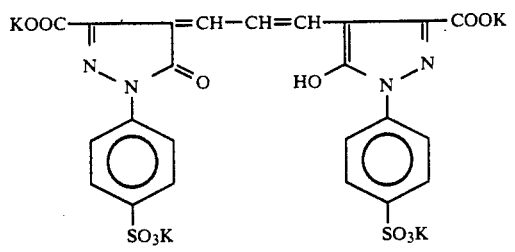
(b)
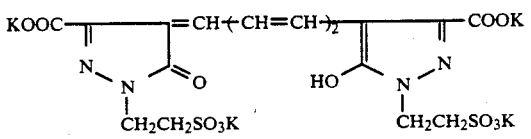
(c)
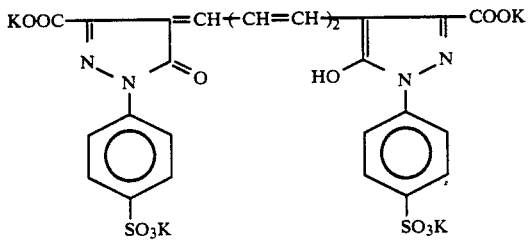
(d)
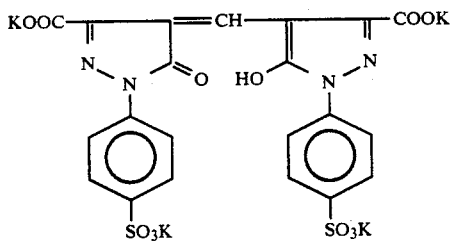
(e)
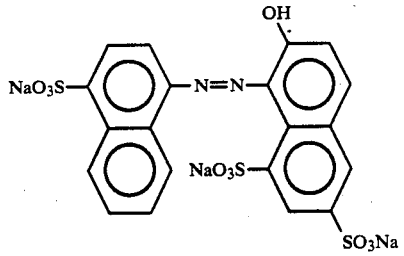
(f)
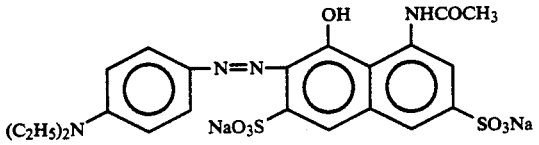
(g)
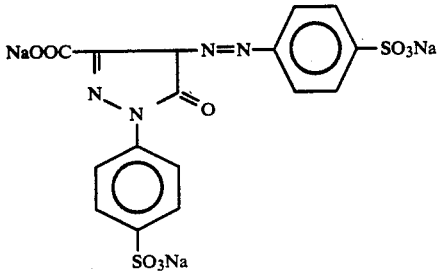

-continued
(h)
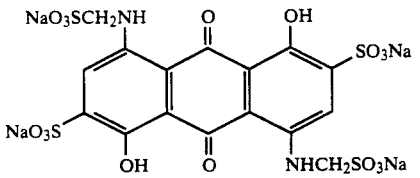
(i)
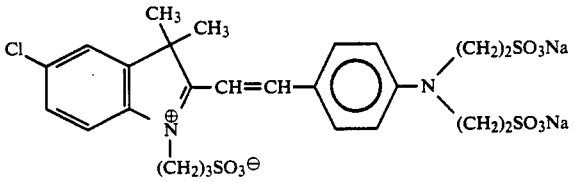
(j)
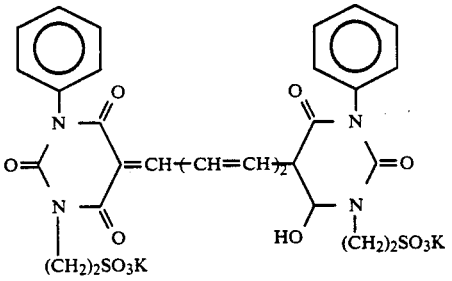
(k)
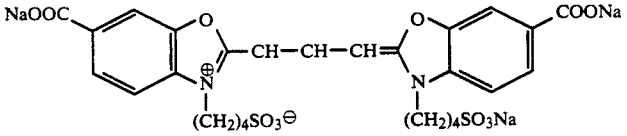
(l)
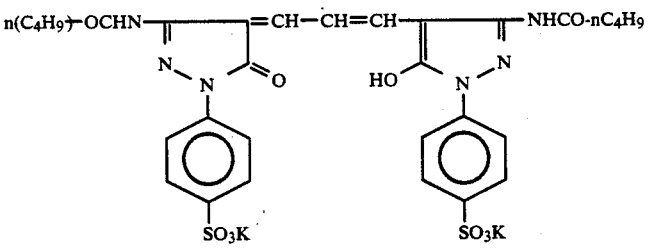
(m)
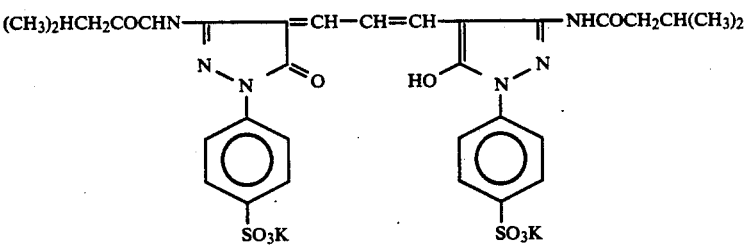
(n)
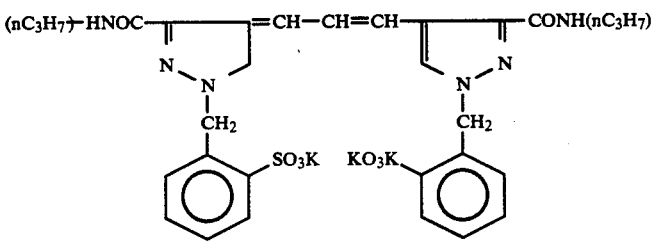

-continued

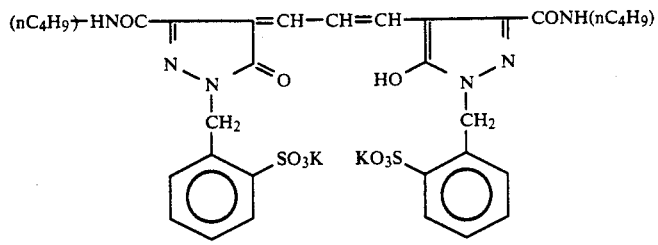

(o)

In using these dyes, it is effective that a specific layer of a light-sensitive material to be dyed with an anionic dye is mordanted by a polymer mordant having cationic sites. In this case, dyes which irreversibly lose their color through development-fixing-washing are preferably utilized. The layer to be mordanted with a polymer having cationic sites may be any of an emulsion layer, a surface protective layer, or a layer on the side opposite to an emulsion layer side, but is preferably a layer between an emulsion layer and a support. For the particular purpose of cross-over cut of both-sided X-ray films for medical use, a subbing layer is the most suitable to be mordanted.

For fixing of dyes, the solid dispersion method described in JP-A-55-155350 or WO 88/0479 is effective.

Where a subbing layer is to be mordanted, polyethylene oxide type nonionic surface active agents are preferably used as coating aids in combination with the polymer having cationic sites.

Polymers having cationic sites preferably include anion exchange polymers, such as various known quaternary ammonium salt (or phosphonium salt) polymers. Quaternary ammonium (or phosphonium) salt polymers are widely known as polymer mordants or antistatic polymers and include, for example, aqueous dispersion latices as described in JP-A-59-166940, U.S. Pat. No. 3,958,995, JP-A-55-142339, JP-A-54-126027, JP-A-54-155835, JP-A-53-30328, JP-A-54-92274; polyvinylpyridinium salts as described in U.S. Pat. Nos. 2,548,564, 3,148,061, and 3,756,814; water-soluble quaternary ammonium salt polymers as described in U.S. Pat. No. 3,709,690; and water-insoluble quaternary ammonium salt polymers as described in U.S. Pat. No. 3,898,088.

These anion exchange polymers are preferably used in the form of a crosslinked aqueous polymer latex which is obtained by copolymerizing a monomer having at least two (preferably 2 to 4) ethylenically unsaturated groups so as to prevent migration from a desired layer to other layers or into a processing solution.

Specific examples of such a crosslinked copolymer are shown below.

(A)

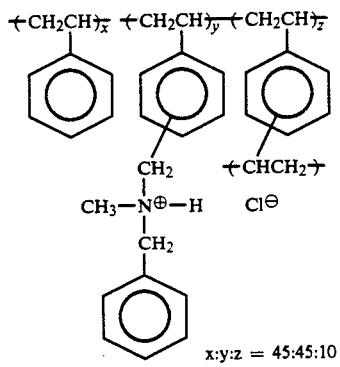

x:y:z = 45:45:10

(B)

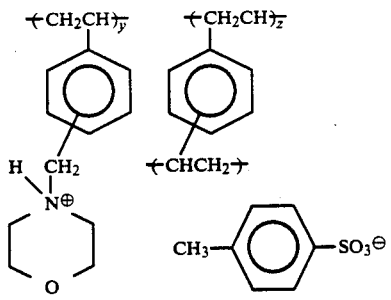

y:z = 95:5

(C)

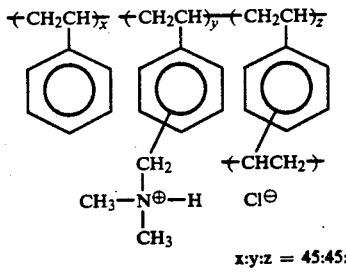

x:y:z = 45:45:10

(D)

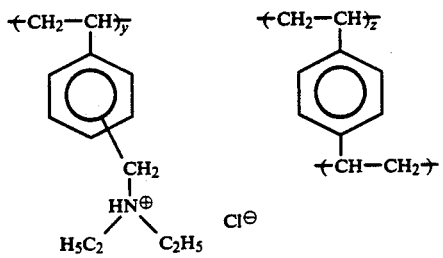

y:z = 80:20

Methods for coating an emulsion layer, a surface protective layer, etc. on a support are not particularly limited. For example, a multi-layer simultaneous coating method as described in U.S. Pat. Nos. 2,761,418, 3,508,947, and 2,761,791 is preferably employed.

A developing solution which can be used in the present invention contains a known developing agent, such as hydroxybenzene developing agents (e.g., hydroquinone), 3-pyrazolidone developing agents (e.g., 1-phenyl-3-pyrazolidone), and aminophenol developing agents (e.g., N-methyl-p-aminophenol), either alone or in combination thereof. A developing solution may further contain other known additives, such as preservatives, alkali agents, pH buffering agents, and antifoggants. If desired, dissolving aids, color toning agents, development accelerators (e.g., quaternary salts, hydrazine derivatives, and benzyl alcohol), surface active agents, defoaming agents, water softeners, hardening agents (e.g., glutaraldehyde), viscosity-imparting agents and so on may also be added to a developing solution.

A fixing solution which can be used in the present invention has a generally employed composition. Useful fixing agents include thiosulfates, thiocyanates, and organic sulfur compounds known to have a fixing action. A fixing solution may contain a water-soluble aluminum salt as a hardening agent.

In carrying out development processing by using an automatic developing machine, roller conveying type automatic developing machines as described in U.S. Pat. Nos. 3,025,779, 3,515,556, 3,573,914, and 3,647,459, and British Patent 1,269,268 are used to advantage.

Developing temperature usually ranges from 18° to 50° C., and preferably from 30° to 45° C., and developing time usually ranges from 4 to 40 seconds, and preferably from 4 to 25 seconds.

A dry-to-dry time from the start of development through fixing and washing up to the end of drying is in the range of from 10 to 200 seconds, preferably from 40 to 100 seconds, and more preferably from 15 to 100 seconds.

Additives of the light-sensitive material other than those mentioned above, methods of development, methods of exposure, and the like are not particularly limited. For the details of these conditions, reference can be made to *Research Disclosure,* Vol. 176, Item 17643 (Dec., 1978) and ibid., Item 18431 (Aug., 1979).

The present invention is now illustrated in greater detail with reference to the following Examples, but it should be understood that the present invention is not deemed to be limited thereto. All the percents, parts, and ratios are given by weight unless otherwise specified.

EXAMPLE 1

Preparation of Comparative Emulsion A

To 1 l of water were added 5 g of potassium bromide, 25.6 g of gelatin, and 2.5 cc of a 5% aqueous solution of a thioether ($HO(CH_2)_2S(CH_2)_2S(CH_2)_2OH$), and the resulting gelatin aqueous solution was kept at 66° C. To the solution were fed an aqueous solution of 8.33 g of silver nitrate and an aqueous solution containing 5.94 g of potassium bromide and 0.726 g of potassium iodide while stirring over a period of 45 seconds in accordance with a double jet process. After 2.9 g of potassium bromide was added thereto, an aqueous solution containing 8.33 g of silver nitrate was further fed over a period of 24 minutes. Then, 20 cc of 25% aqueous ammonia and 10 cc of a 50% $NH_4NO_3$ solution were added thereto, followed by physical ripening for 20 minutes. The mixture was neutralized by addition of 240 cc of 1 N sulfuric acid, and an aqueous solution of 153.34 g of silver nitrate and an aqueous solution of potassium bromide were fed over a period of 40 minutes while maintaining a pAg at 8.2 in accordance with a controlled double jet process. The feed rate of the solutions was accelerated in such a manner that the final feed rate was 9 times the initial one. After the addition, 15 cc of a 2 N potassium thiocyanate solution was added, and then 45 cc of a 1% potassium iodide aqueous solution was added thereto over a period of 30 seconds. The temperature was lowered to 35° C., and soluble salts were removed by sedimentation using a high-molecular weight coagulating agent. The temperature was raised to 40° C., and gelatin, 76 mg of Proxel (a product produced by I.C.I. Co.), and 760 mg of phenoxyethanol were added to the emulsion. The emulsion was adjusted to a pH of 6.50 and a pAg of 8.20 with sodium hydroxide and potassium bromide.

The temperature was elevated to 56° C., and 520 mg of Sensitizing Dye (14) of the present invention was added to the emulsion. Ten minutes later, 3.4 mg of sodium thiosulfate pentahydrate, 140 mg of potassium thiocyanate, and 3.1 mg of chloroauric acid were added thereto and, after 70 minutes, the emulsion was quenched to solidify to prepare Emulsion A. Emulsion A was found to comprise grains having an aspect ratio of 3 or more in a proportion of 99.5% based on the total projected area of total grains. All the grains having an aspect ratio of 2 or more were found to have a mean projected area diameter of 1.35 μm, a standard deviation of 22.3%, an average thickness of 0.200 μm, and an average aspect ratio of 6.8.

Preparation of Comparative Emulsion B

Tabular silver halide grains were formed in the same manner as for Emulsion A. After removing soluble salts by sedimentation, antiseptics were added, and the pH and pAg were adjusted in the same manner as for Emulsion A.

The temperature was raised to 56° C., and the emulsion was subjected to chemical sensitization in the same manner as for Emulsion A, except that 186 mg of 4-hydroxy-6-methyl-1,3,3a,7-tetraazaindene was added to the emulsion 10 minutes before the addition of Sensitizing Dye (14).

Preparation of Emulsion C of the Invention

To 1 l of water were added 5 g of potassium bromide, 25.6 g of gelatin, and 2.5 cc of a 5% aqueous solution of a thioether ($HO(CH_2)_2S(CH_2)_2S(CH_2)_2OH$), and the resulting gelatin solution was kept at 66° C. To the solution were fed an aqueous solution containing 8.33 g of silver nitrate and an aqueous solution containing 5.94 g of potassium bromide and 0.726 g of potassium iodide while stirring over a period of 45 seconds according to a double jet process. Subsequently, 2.9 g of potassium bromide was added thereto, and an aqueous solution containing 8.33 g of silver nitrate was then fed thereto over 24 minutes. Then, 0.1 mg of thiourea dioxide of formula:

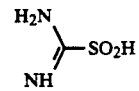

was added to the mixture. Thereafter, 20 cc of 25% aqueous ammonia and 10 cc of a 50% $NH_4NO_3$ solution were added, followed by physical ripening for 20 minutes. After neutralization by addition of 240 cc of 1 N sulfuric acid, an aqueous solution containing 153.34 g of silver nitrate and an aqueous solution of potassium bromide were added to the emulsion over 40 minutes while maintaining a pAg at 8.2 according to a controlled double jet process. The feed rate of the solutions was accelerated in such a manner that the final rate was 9 times the initial one. After completion of the addition, 15 cc of a 2N potassium thiocyanate solution was added, and 45 cc of a 1% potassium iodide aqueous solution was then added over 30 seconds. The temperature was lowered to 35° C., and soluble salts were removed by sedimentation. The temperature was raised to 40° C., and gelatin, 76 mg of Proxel, and 760 mg of phenoxyethanol were added thereto. The emulsion was adjusted to a pH of 6.50 and a pAg of 8.20 with sodium hydroxide and potassium bromide.

After raising the temperature to 56° C., 520 mg of Sensitizing Dye (14) was added. After 10 minutes, 3.4 mg of sodium thiosulfate pentahydrate, 140 mg of potassium thiocyanate, and 3.1 mg of chloroauric acid were added to the emulsion. Fifty minutes later, the emulsion was quenched to solidify to obtain Emulsion C.

Emulsion C was found to comprise grains having an aspect ratio of 3 or more in a proportion of 99.5% based on the total projected area of the total grains. All the grains having an aspect ratio of 2 or more were found to have a mean projected area diameter of 1.35 μm, a standard deviation of 22.3%, an average thickness of 0.200 μm, and an average aspect ratio of 6.8, showing no difference from Emulsion A.

Preparation of Emulsion D of the Invention

Grain formation was carried out by using thiourea dioxide in the same manner as for Emulsion C.

After removing soluble salts by sedimentation, the pH and pAg were adjusted, and the temperature of the emulsion was raised to 56° C. The emulsion was then subjected to chemical sensitization in the same manner as for Emulsion A, except that 186 mg of 4-hydroxy-6-methyl-1,3,3a,7-tetraazaindene was added ten minutes before the addition of Sensitizing Dye (14).

Preparation of Emulsion E of the Invention

Grain formation was conducted by using thiourea dioxide in the same manner as for Emulsion C.

After removing soluble salts by sedimentation, antiseptic agents were added to the emulsion, and the pH and pAg of the emulsion were adjusted in the same manner as for Emulsion A.

The temperature was raised to 56° C., and 0.39 mg of thiourea dioxide was added to the emulsion, followed by stirring for 20 minutes. Then, 213 mg of 4-hydroxy-6-methyl-1,3,3a,7-tetraazaindene was added thereto. Ten minutes later, 520 mg of Sensitizing Dye (14) was added to the emulsion. Ten minutes later, 3.4 mg of sodium thiosulfate pentahydrate, 140 mg of potassium thiocyanate, and 3.1 mg of chloroauric acid were added to the emulsion and, after 50 minutes, the emulsion was quenched to solidify to obtain Emulsion E.

Preparation of Emulsion F of the Invention

To 1 l of water were added 5 g of potassium bromide, 25.6 g of gelatin, and 2.5 cc of a 5% aqueous solution of a thioether ($HO(CH_2)_2S(CH_2)_2S(CH_2)_2OH$), and the solution was kept at 66° C. To the solution were added an aqueous solution containing 8.33 g of silver nitrate and an aqueous solution containing 5.94 g of potassium bromide and 0.726 g of potassium iodide while stirring over 45 seconds according to a double jet process. After 2.9 g of potassium bromide was added, an aqueous solution containing 8.33 g of silver nitrate was fed thereto over 24 minutes. To the emulsion was then added 0.2 mg of thiourea dioxide. Thereafter, 20 cc of 25% aqueous ammonia and 10 cc of 50% $NH_4NO_3$ were added to the emulsion to conduct physical ripening for 20 minutes, followed by neutralization with 240 cc of 1 N sulfuric acid. An aqueous solution containing 153.34 g of silver nitrate and a potassium bromide aqueous solution were then fed thereto over 40 minutes while maintaining at a pAg of 8.2 according to a controlled double jet process. The feed rate of the solutions was increased in such a manner that the final rate was 9 times the initial one. After 20 minutes from the start of feeding, 10 mg of sodium thiosulfonate ($C_2H_5SO_2SNa$) was added to the mixture. After completion of the feeding, 15 cc of a 2 N potassium thiocyanate solution was added, and then 45 cc of a 1% potassium iodide aqueous solution was added thereto over 30 seconds. The temperature was lowered to 35° C., and soluble salts were removed by sedimentation. The temperature was raised to 40° C., gelatin, 76 mg of Proxel, and 760 mg of phenoxyethanol were added to the emulsion, and the emulsion was adjusted to a pH of 6.50 and pAg of 8.20 with sodium hydroxide and potassium bromide.

The temperature was increased to 56° C., and 186 mg of 4-hydroxy-6-methyl-1,3,3a,7-tetraazaindene was added to the emulsion. Ten minutes later, 520 mg of Sensitizing Dye (14) was added. Ten minutes later, 3.4 mg of sodium thiosulfate pentahydrate, 140 mg of potassium thiocyanate, and 3.1 mg of chloroauric acid were added to the emulsion and, after 50 minutes, the emulsion was quenched to solidify to obtain Emulsion F.

Emulsion F showed no difference from Emulsion A in grain size, aspect ratio, etc. within allowable errors in measurements.

Preparation of Emulsion Coating Composition

To each of Emulsions A to F, the following chemicals were added in amounts shown each per mol of silver halide.

| | |
|---|---|
| Polymer latex (ethyl acrylate/methacrylic acid (97/3) copolymer) | 25.0 g |
| Hardening agent (1,2-bis(sulfonylacetamido)ethane) | 3.0 g |
| 2,6-Bis(hydroxyamino)-4-diethylamino-1,3,5-triazine | 80 mg |
| Sodium polyacrylate (average molecular weight: 41,000) | 1 g |
| Potassium polystyrenesulfonate (average molecular weight: 600,000) | 1.0 g |
| Dextran (average molecular weight: 39,000) | 11.4 g |

Preparation of Support

On each side of a 175 μm thick blue-tinted polyethylene terephthalate film support was coated a subbing layer having the following composition.

[Subbing Layer Formulation]

Gelatin 84 mg/m²

60 mg/m²

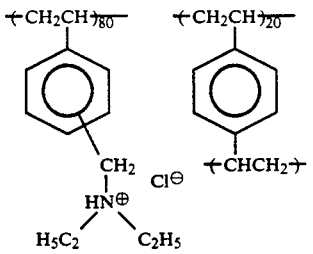

17 mg/m²

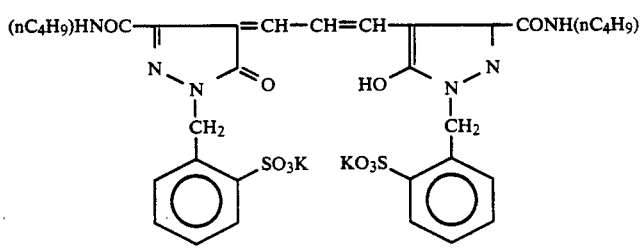

Preparation of Light-Sensitive Material

On each side of the above polyethylene terephthalate support were simultaneously coated the above-prepared emulsion coating composition and a surface protective layer coating composition having the following composition. The silver coverage was 1.9 g/m² per one side of the support. The thus obtained light-sensitive materials were designated Samples 101 to 118.

| [Surface Protective Layer] | |
|---|---|
| Gelatin | 0.8 g/m² |
| Polyacrylamide (average molecular weight: 45,000) | 0.2 g/m² |
| Sodium polyacrylate (average molecular weight: 400,000) | 0.02 g/m² |
| Sodium salt of p-t-Octylphenoxydiglyceryl butylsulfonate | 0.02 g/m² |
| Poly(degree of polymerization n = 10)oxyethylene cetyl ether | 0.035 g/m² |
| Poly(n = 10)oxyethylene-poly(n = 3)oxyglyceryl p-octylphenoxy ether | 0.01 g/m² |
| 4-Hydroxy-6-methyl-1,3,3a,7-tetraazaindene | 0.0155 g/m² |
| Hydroquinone | 0.117 g/m² |
| $C_8F_{17}SO_3K$ | 0.003 g/m² |
| $C_8F_{17}SO_2N(C_3H_7)(CH_2CH_2O)_4(CH_2)_4SO_3Na$ | 0.001 g/m² |
| $C_8F_{17}SO_2N(C_3H_7)(CH_2CH_2O)_{10}(CH_2CH(OH)CH_2O)_4H$ | 0.003 g/m² |
| Polymethyl methacrylate (average particle size: 3.5 μm) | 0.025 g/m² |
| Methyl methacrylate/methacrylate (7:3 by mole) copolymer (average particle size: 2.5 μm) | 0.020 g/m² |

Evaluation of Performance

1) Sensitivity

Each of Samples 101 to 118 was set in a cassette with both sides thereof being in intimate contact with an X-ray intensifying screen ("GRENEX Ortho Screen HR-4" produced by Fuji Photo Film Co., Ltd.), and X-ray sensitometry was conducted. The exposure amount was adjusted by changing the distance between an X-ray tube and the cassette. After exposure, the sample was processed in an automatic developing machine ("FPM-9000" manufactured by Fuji Photo Film Co., Ltd.) using a developing solution and a fixing solution having the following formulation.

A reciprocal of an exposure amount which gave a density of fog+1.0 was determined and expressed relatively taking the result of Sample 101 as a standard (100). The results obtained are shown in Table 1 below.

2) Pressure Resistance

Each sample was bent to make an angle of 30° and then developed under the following conditions. Pressure resistance was evaluated by the degree of blackening according to the following standards, and the results obtained are shown in Table 1.

[Standard of Evaluation]

| | |
|---|---|
| Good . . . | No problem for practical use |
| Medium . . . | Slightly blackened, but acceptable for practical use |
| Bad . . . | Blackened and unacceptable for practical use |

[Processing Procedure]

| | |
|---|---|
| Development | 35° C. × 5.3 sec |
| Fixing | 31° C. × 5.6 sec |
| Washing | 15° C. × 3.3 sec |
| Squeegee | 3.3 sec |
| Drying | 50° C. × 6.7 sec |
| Dry-to-dry time: | 25 sec |

[Developing Solution Formulation]

| | |
|---|---|
| Potassium hydroxide | 29 g |
| Potassium sulfite | 44.2 g |
| Sodium hydrogencarbonate | 7.5 g |
| Boric acid | 1.0 g |
| Diethylene glycol | 12 g |
| Ethylenediaminetetraacetic acid | 1.7 g |
| 5-Methylbenzotriazole | 0.06 g |
| Hydroquinone | 25 g |
| Glacial acetic acid | 18 g |
| Triethylene glycol | 12 g |
| 5-Nitroindazole | 0.25 g |
| 1-Phenyl-3-pyrazolidone | 2.8 g |
| Glutaraldehyde (50%) | 9.86 g |
| Sodium metabisulfite | 12.6 g |
| Potassium bromide | 3.7 g |
| Water to make | 1.0 l |

-continued

| [Fixing Solution Formulation] | |
|---|---|
| Ammonium thiosulfate (70 w/v %) | 200 ml |
| Disodium ethylenediaminetetraacetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |
| Water to make | 1.0 l |
| pH | 4.25 |

TABLE 1

| Sample No. | Emulsion Layer: Emulsion | Emulsion Layer: Gelatin ($g/m^2$) | Emulsion Layer: Poly-acrylamide ($g/m^2$) | Sensi-tivity | Pressure Resistance | Coating Weight Per One Side of Total Binder ($g/m^2$) | Remark |
|---|---|---|---|---|---|---|---|
| 101 | A | 2.4 | 0.2 | 100 | Bad | 3.64 | Comparison |
| 102 | B | " | " | 85 | Bad | " | " |
| 103 | C | " | " | 105 | Medium | " | Invention |
| 104 | D | " | " | 105 | Good | " | " |
| 105 | E | " | " | 105 | Good | " | " |
| 106 | F | " | " | 110 | Good | " | " |
| 107 | A | 2.8 | " | 95 | Medium | 4.04 | Comparison |
| 108 | B | " | " | 85 | Medium | " | " |
| 109 | C | " | " | 100 | Medium | " | Invention |
| 110 | D | 2.8 | 0.2 | 100 | Good | 4.04 | Invention |
| 111 | E | " | " | 105 | Good | " | " |
| 112 | F | " | " | 105 | Good | " | " |
| 113 | A | 3.2 | " | 90 | Good | 4.44 | Comparison |
| 114 | B | " | " | 80 | Good | " | " |
| 115 | C | " | " | 100 | Good | " | " |
| 116 | D | " | " | 100 | Good | " | " |
| 117 | E | " | " | 105 | Good | " | " |
| 118 | F | " | " | 105 | Good | " | " |

As can be seen from Table 1, the light-sensitive materials according to the present invention have improved pressure resistance without undergoing reduction in sensitivity. Samples 13 to 18 came out of the automatic developing machine while insufficiently dry.

EXAMPLE 2

Preparation of Emulsion A'

To 1 l of water were added 4.5 g of potassium bromide, 20.6 g of gelatin, and 2.5 cc of a 5% aqueous solution of a thioether ($HO(CH_2)_2S(CH_2)_2S(CH_2)_2OH$), and the resulting gelatin aqueous solution was kept at 65° C. To the solution were fed an aqueous solution of 3.43 g of silver nitrate and an aqueous solution containing 2.97 g of potassium bromide and 0.36 g of potassium iodide while stirring over a period of 37 seconds in accordance with a double jet process. After 0.9 g of potassium bromide was added thereto, an aqueous solution containing 4.92 g of silver nitrate was further fed over a period of 13 minutes. The temperature was raised to 70° C., and 18 cc of 25% aqueous ammonia was added thereto, followed by neutralization with 17 cc of 100% acetic acid. An aqueous solution of 133.49 g of silver nitrate and an aqueous solution of potassium bromide were fed over a period of 35 minutes while maintaining a pAg at 8.2 in accordance with a controlled double jet process. The feed rate of the solutions was accelerated in such a manner that the final feed rate was 2.6 times the initial one. After the addition, 15 cc of a 2 N potassium thiiocyanate solution was added, and then 38.5 cc of a 1% potassium iodide aqueous solution was added thereto over a period of 30 seconds. The temperature was lowered to 35° C., and soluble salts were removed by sedimentation. The temperature was raised to 40° C., and 68 g of gelatin and 2.35 g of phenoxyethanol were added to the emulsion. The emulsion was adjusted to a pH of 6.50 and a pAg of 8.20 with sodium hydroxide and potassium bromide.

The temperature was elevated to 56° C., and 154 mg of 4-hydroxy-6-methyl-1,3,3a,7-tetraazaindene was added to the emulsion. Ten minutes later, 500 mg of Sensitizing Dye (14) was added to the emulsion. Ten minutes later, 3.3 mg of sodium thiosulfate pentahydrate, 118 mg of potassium thiocyanate, and 2 mg of chloroauric acid were added thereto and, after 70 minutes, the emulsion was quenched to solidify to prepare Emulsion A'.

Emulsion A' was found to comprise grains having an aspect ratio of 3 or more in a proportion of 99.5% of the total projected area of total grains. All the grains having an aspect ratio of 3 or more were found to have a mean projected area diameter of 1.35 μm, a standard deviation of 22.3%, an average thickness of 0.200 μm, and an average aspect ratio of 6.8.

Preparation of Emulsion B'

To 1 l of water were added 4.5 g of potassium bromide, 20.6 g of gelatin, and 2.5 cc of a 5% aqueous solution of a thioether ($HO(CH_2)_2S(CH_2)_2S(CH_2)_2OH$), and the resulting gelatin solution was kept at 65° C. To the solution were fed an aqueous solution containing 3.43 g of silver nitrate and an aqueous solution containing 2.97 g of potassium bromide and 0.36 g of potassium iodide while stirring over a period of 37 seconds according to a double jet process. Then, 0.1 mg of thiourea dioxide was added to the mixture. The temperature was raised to 70° C., and 18 cc of 25% aqueous ammonia was added thereto, followed by neutralization with 17 cc of 100% acetic acid. Subsequently, an aqueous solution containing 133.4 g of silver nitrate was added to the emulsion over 35 minutes while maintaining a pAg at 8.2 according to a controlled double jet process. The feed rate of the silver nitrate solution was accelerated in such a manner that the final rate was 2.6 times the initial one. After completion of the addition, 15 cc of a 2 N potassium thiocyanate solution was added, and 38.5 cc of a 1% potassium iodide aqueous solution was then added over 30 seconds. The temperature was lowered to 35° C., and soluble salts were removed by sedimentation. The temperature was raised to 40° C., and 68 g of gelatin and 2.35 g of phenoxyethanol were added thereto. The emulsion was adjusted to a pH of 6.50 and a pAg of 8.20 with sodium hydroxide and potassium bromide.

After raising the temperature to 56° C., 0.05 mg of thiourea dioxide was added to the emulsion, followed by stirring for 20 minutes. Then, 154 mg of 4-hydroxy-6-methyl-1,3,3a,7-tetraazindene was added and, ten minutes later, 500 mg of Sensitizing Dye (14) was added to the emulsion. After 10 minutes, 3.3 mg of sodium thiosulfate pentahydrate, 118 mg of potassium thiocyanate, and 2 mg of chloroauric acid were added to the emulsion. Seventy minutes later, the emulsion was quenched to solidify to obtain Emulsion B'.

Emulsion B' showed no difference from Emulsion A' in grain size, aspect ratio, etc. within allowable errors of measurements.

To determine an adsorption of the sensitizing dye, each of Emulsions A' and B' was centrifuged, and an absorbance of the supernatant liquor was measured. As a result, both emulsions were found to have a saturation adsorption (100%).

Preparation of Emulsion Coating Composition:

To each of Emulsions A' and B', the following chemicals were added in amounts shown each per mol of silver halide.

| | |
|---|---|
| Polymer latex (polyethyl acrylate/methacrylic acid (97/3) copolymer) | 20.0 g |
| Hardening agent (1,2-bis(vinylsulfonyl-acetamido)ethane) | 2.4 g |
| 2,6-Bis(hydroxyamino)-4-diethylamino-1,3,5-triazine | 76 mg |
| Sodium polyacrylate (average molecular weight: 41,000) | 2.1 g |
| Sodium polystyrenesulfonate (average molecular weight: 600,000) | 1.0 g |
| Dextran (average molecular weight: 39,000) | 23.6 g |
| Trimethylolpropane | 9.8 g |
| Potassium hydroquinone monosulfonate | see Table 2 |
| 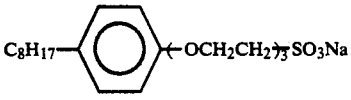 | 0.6 g |
| Compound of formula (I) | see Table 2 |

Preparation of Support

On each side of a 175 μm thick blue-tinted polyethylene terephthalate film support was coated a subbing layer comprising 84 mg/m² of gelatin.

Preparation of Light-Sensitive Material

On each side of the polyethylene terephthalate support were simultaneously coated the above-prepared emulsion coating composition and a surface protective layer coating composition having the following composition. The silver coverage and binder coverage were 1.95 g/m² and 3.5 g/m², respectively, per one side of the support. The thus obtained light-sensitive materials were designated Samples 201 to 215.

| [Surface Protective Layer] | |
|---|---|
| Gelatin | 1.138 g/m² |
| Dextran (average molecular weight: 39,000) | 0.228 g/m² |
| 4-Hydroxy-6-methyl-1,3,3a,7-tetraazaindene | 0.0155 g/m² |
| Sodium polyacrylate (average molecular weight: 41,000) | 0.023 g/m² |
| 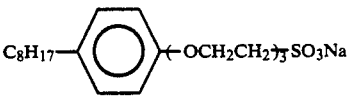 | 0.0225 g/m² |
| $C_{16}H_{33}O(CH_2CH_2O)_{10}H$ | 0.035 g/m² |
| $C_8F_{17}SO_2N(C_3H_7)(CH_2CH_2O)_4(CH_2)_4SO_3Na$ | 0.0005 g/m² |
| $C_8F_{17}SO_3K$ | 0.0053 g/m² |
| Polymethyl methacrylate (average particle size: 3.7 μm) | 0.088 g/m² |
| Proxel | 0.0006 g/m² |

Evaluation of Performance

1) Sensitivity and Fog

Each of Samples 201 to 215 was exposed on both sides thereof to green light having a peak at 550 nm for 1/10 second and then processed in an automatic developing machine (37 FPM 9000" using a developing solution ("RD 7" produced by Fuji Photo Film) and a fixing solution ("Fuji F" produced by Fuji Photo Film) at 35° C. with a dry-to-dry time of 45 seconds (SP processing).

A reciprocal of an exposure amount which gave a density of fog+1.0 was determined and expressed relatively taking the result of Sample 206 as a standard (100). The results obtained are shown in Table 2 below.

Fog was expressed as a total value inclusive of the density of the support. The fog value of the support per se was 0.125 when processed in the above-described automatic developing machine.

2) Scratch Resistance

The sample was conditioned at 25° C. and 25% RH for 90 minutes, and rubbed with a commercially available nylon brush under a load of 100 g over an area of 2×1 cm at a speed of 1 cm/sec under the same environmental conditions. The sample (unexposed) was then processed under the same conditions as described above, and the number of blackened streaks was counted. A sample having not more than 30 streaks was judged as acceptable for practical use. The results obtained are shown in Table 2.

TABLE 2

| Sample No. | Emulsion | Compound of (I) Kind | Compound of (I) Amount (mol/mol-Ag) | Amount of Potassium Hydroquinone Monosulfonate (mol/mol-Ag) | Sensitivity | Fog | Number of Streaks | Remark |
|---|---|---|---|---|---|---|---|---|
| 201 | A' | — | — | — | 126 | 0.155 | 46 | Comparison |
| 202 | B' | — | — | — | 159 | 0.160 | 58 | " |
| 203 | A' | — | — | 0.043 | 110 | 0.152 | 35 | " |
| 204 | B' | — | — | 0.043 | 138 | 0.157 | 45 | " |
| 205 | A' | I-13 | $1.1 \times 10^{-4}$ | — | 115 | 0.153 | 35 | " |
| 206 | A' | " | " | 0.043 | 100 | 0.150 | 30 | " |

TABLE 2-continued

| Sample No. | Emulsion | Compound of (I) Kind | Compound of (I) Amount (mol/mol-Ag) | Amount of Potassium Hydroquinone Monosulfonate (mol/mol-Ag) | Sensitivity | Fog | Number of Streaks | Remark |
|---|---|---|---|---|---|---|---|---|
| 207 | B' | " | $2.2 \times 10^{-4}$ | — | 142 | 0.158 | 30 | Invention |
| 208 | B' | " | $1.1 \times 10^{-4}$ | 0.022 | 132 | 0.155 | 27 | " |
| 209 | B' | " | " | 0.043 | 126 | 0.155 | 22 | " |
| 210 | B' | " | $0.5 \times 10^{-4}$ | 0.043 | 132 | 0.155 | 30 | " |
| 211 | B' | " | $2.2 \times 10^{-4}$ | 0.043 | 123 | 0.155 | 20 | " |
| 212 | B' | I-15 | $1.1 \times 10^{-4}$ | 0.043 | 126 | 0.155 | 21 | " |
| 213 | B' | I-3 | " | 0.043 | 123 | 0.155 | 22 | " |
| 214 | B' | I-5 | " | 0.043 | 126 | 0.155 | 20 | " |
| 215 | B' | I-8 | " | 0.043 | 126 | 0.155 | 23 | " |

It can be seen from the results in Table 2 that the light-sensitive materials according to the present invention (Samples 207 to 215) are superior in sensitivity-scratch resistance balance. It is also seen that a combined use of the compound of formula (I) and a polyhydroxybenzene compound produces enhanced effects.

EXAMPLE 3

Preparation of Emulsion C'

To 1 l of water were added 5 g of potassium bromide, 0.05 g of potassium iodide, 30 g of gelatin, and 2.5 cc of a 5% aqueous solution of a thioether ($HO(CH_2)_2S(CH_2)_2S(CH_2)_2OH$), and the resulting gelatin aqueous solution was kept at 75° C. To the solution were fed an aqueous solution of 6.49 g of silver nitrate and an aqueous solution containing 5.72 g of potassium bromide and 0.70 g of potassium iodide while stirring over a period of 45 seconds in accordance with a double jet process. After 2.92 g of potassium bromide was added thereto, an aqueous solution containing 10.19 g of silver nitrate was further fed over a period of 13 minutes. Subsequently, an aqueous solution containing 166.90 g of silver nitrate and an aqueous solution of potassium bromide were fed over a period of 30 minutes while maintaining a pAg at 8.1 in accordance with a controlled double jet process. The feed rate of the solutions was accelerated in such a manner that the final feed rate was 6.8 times the initial one. After the addition, 15 cc of a 2N potassium thiocyanate solution was added, and then 61 cc of a 1% potassium iodide aqueous solution was added thereto over a period of 30 seconds. The temperature was lowered to 35° C., and soluble salts were removed by sedimentation. The temperature was raised to 40° C., and 95.4 g of gelatin and 2.5 g of phenol were added to the emulsion. The emulsion was adjusted to a pH of 6.50 and a pAg of 8.20 with sodium hydroxide and potassium bromide.

The temperature was elevated to 56° C., and 202 mg of 4-hydroxy-6-methyl-1,3,3a,7-tetraazaindene was added to the emulsion. Ten minutes later, 668 mg of Sensitizing Dye (14) was added to the emulsion. Ten minutes later, 4.7 mg of sodium thiosulfate pentahydrate, 157 mg of potassium thiocyanate, and 4.5 mg of chloroauric acid were added thereto and, after 70 minutes, the emulsion was quenched to solidify to prepare Emulsion C'.

Emulsion C' was found to comprise grains having an aspect ratio of 3 or more in a proportion of 93% of the total projected area of total grains. All the grains having an aspect ratio of 2 or more were found to have a mean projected area diameter of 0.93 μm, a standard deviation of 43.8%, an average thickness of 0.182 μm, and an average aspect ratio of 6.9. The amount of the adsorbed sensitizing dye was found to be 102% of the saturated adsorption.

Preparation of of Emulsion D'

Grain formation was carried out in the same manner as for Emulsion C'. After removal of soluble salts by sedimentation, the pH and pAg were adjusted to the same values as in Emulsion C'. The temperature of the emulsion was raised to 56° C., and 0.03 mg of thiourea dioxide was added thereto, followed by stirring for 20 minutes. Then, 202 mg of 4-hydroxy-6-methyl-1,3,3a,7-tetraazaindene was added and, 10 minutes later, 668 mg of Sensitizing Dye (14) was added. After 10 minutes, 4.7 mg of sodium thiosulfate pentahydrate, 157 mg of potassium thiocyanate, and 4.5 mg of chloroauric acid were added to the emulsion. Seventy minutes later, the emulsion was quenched to solidify to obtain Emulsion D'.

Emulsion D' showed no difference from Emulsion C' in grain size, aspect ratio, adsorption of sensitizing dye, etc. within allowable errors of measurements.

Preparation of Emulsion Coating Composition

To each of Emulsions C' and D', the following chemicals were added in amounts shown each per mol of silver halide.

| | |
|---|---|
| Polymer latex (ethyl acrylate/methacrylic acid (97/3) copolymer) | 24.2 g |
| Hardening agent (1,2-bis(vinylsulfonyl-acetamido)ethane) | 3.5 g |
| 2,6-Bis(hydroxyamino)-4-diethylamino-1,3,5-triazine | 92 mg |
| Sodium polyacrylate (average molecular weight: 400,000) | 2.6 g |
| Sodium polystyrenesulfonate (average molecular weight: 600,000) | 0.78 g |
| Polyacrylamide (average molecular weight: 41,000) | 28.8 g |
| Potassium bromide | 75 mg |

Preparation of Support

On each side of a 175 μm thick blue-tinted polyethylene terephthalate film support was coated a subbing layer having the following composition.

| | |
|---|---|
| Gelatin | 84 mg/m$^2$ |

-continued

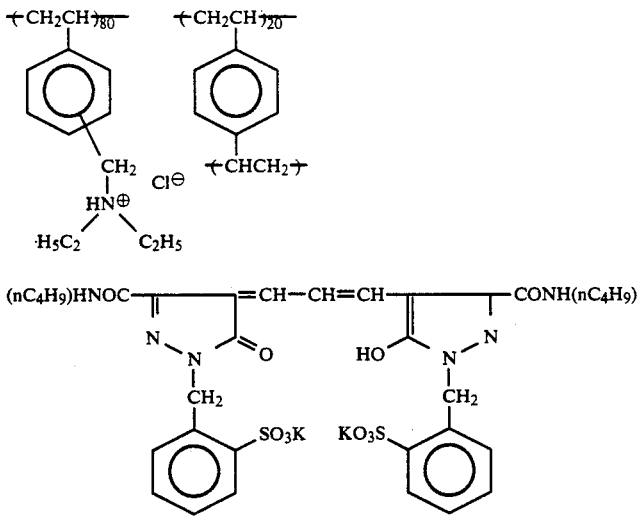

60 mg/m²

17 mg/m²

Preparation of Light-Sensitive Material

On each side of the polyethylene terephthalate support were simultaneously coated the above-prepared emulsion coating composition and a surface protective layer coating composition having the following composition. The silver coverage and binder coverage were 1.63 g/m² and 3.5 g/m², respectively, per one side of the support. The thus obtained light-sensitive materials were designated Samples 301 to 305.

| [Surface Protective Layer] | |
|---|---|
| Gelatin | 0.966 g/m² |
| Polyacrylamide (average molecular weight: 45,000) | 0.227 g/m² |
| 4-Hydroxy-6-methyl-1,3,3a,7-tetra-azaindene | 0.0155 g/m² |
| Sodium polyacrylate (average molecular weight: 400,000) | 0.023 g/m² |
| 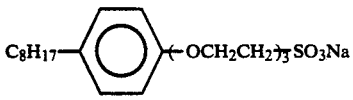 | 0.013 g/m² |
| $C_{16}H_{33}O(CH_2CH_2O)_{10}H$ | 0.045 g/m² |
| $C_{17}H_{33}CON(CH_3)CH_2CH_2SO_3Na$ | 0.0065 g/m² |
| $C_8F_{17}SO_2N(C_3H_7)(CH_2CH_2O)_{15}H$ | 0.003 g/m² |
| $C_8F_{17}SO_2N(C_3H_7)(CH_2CH_2O)_4(CH_2)_4SO_3Na$ | 0.001 g/m² |
| Polymethyl methacrylate (average particle size: 3.7 μm) | 0.087 g/m² |
| Chlorohydroquinone | 0.046 g/m² |
| Proxel | 0.0005 g/m² |

Evaluation of Performance

Photographic properties and scratch resistance of the resulting samples were evaluated in the same manner as in Example 2, except for using the following processing conditions. The sensitivity was relatively expressed taking that of Sample 301 as a standard (100).

Preparation of Processing Solutions

| [Concentrated Developing Solution] | |
|---|---|
| Part A: | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriaminepentaacetic acid | 30 g |
| 3,3'-Dithiobishydrocinnamic acid | 3 g |
| 5-Methylbenzotriazole | 0.025 g |
| Hydroquinone | 450 g |
| Potassium bromide | 15 g |
| Water to make | 4125 ml |
| Part B: | |
| Triethylene glycol | 525 g |
| Glacial acetic acid | 102.6 g |
| 5-Nitroindazole | 3.75 g |
| 1-Phenyl-3-pyrazolidone | 34.5 g |
| Water to make | 750 ml |
| Part C: | |
| Glutaraldehyde (50%) | 150 g or 0 g |
| Potassium metabisulfite | 150 g |
| Water to make | 750 ml |
| [Concentrated Fixing Bath] | |
| Ammonium thiosulfate (70% w/v %) | 200 ml |
| Disodium ethylenediaminetetraacetate dihydrate | 0.03 g |
| Sodium thiosulfate pentahydrate | 10 g |
| Sodium sulfite | 15 g |
| Boric acid | 4 g |
| 1-(N,N-Dimethylamino)ethyl-5-mercaptotetrazole | 1 g |
| Tartaric acid | 3.2 g |
| Glacial acetic acid | 31.5 g |
| Sodium hdyroxide | 11 g |
| Sulfuric acid (36N) | 3.9 g |
| Aluminum sulfate | 10 g |
| Water to make | 400 ml |
| pH | 4.65 |

Each part of the developing solution concentrate was filled in a separate polyethylene container connected in parallel such that the component concentrated solutions were delivered to a common mixing tank for dilution.

The fixing solution concentrate was also filled in a polyethylene container.

When development was started, the development tank and fixing tank were filled with these concentrates in the following proportion by means of a constant delivery pump.

| | |
|---|---|
| Developing Solution: | |
| Part A | 55 ml |
| Part B | 10 ml |
| Part C | 10 ml |
| Water | 125 ml |
| pH = 10.50 | |
| Fixing Solution: | |
| Concentrate | 80 ml |
| Water | 120 ml |
| pH = 4.65 | |

Tap water was filled in a washing tank. Four bags of non-woven cloth each containing 50 g of a silver slow-releasing agent comprising $Na_2O/B_2O_5/SiO_2$ soluble glass containing 0.5% of $Ag_2O$ were sunk to the bottom of the washing tank.

Construction of Automatic Developing Machine

An automatic developing machine having the following construction was used.

| Processing Step | Tank Volume (l) | Processing Temperature (°C.) | Processing Pass Length (mm) | Processing Time (sec) |
|---|---|---|---|---|
| Development | 15 | 35 | 613 | 13.3 |
| | (liquid surface area/tank volume = 35 $cm^2$/l) | | | |
| Fixing | 15 | 32 | 541 | 11.7 |
| Washing | 13 | 17 (running water) | 305 | 5.7 |
| Squeegee | — | — | — | 6.6 |
| Drying | — | 58 | 368 | 8.0 |
| Total | | | 1827 | 45.3 |

Processing

Sample 301 was uniformly exposed to X-ray to provide a density of 1.0 and processed using the above-described automatic developing machine and processing solutions. The developing solution and the fixing solution were replenished at a rate of 25 ml and 25 ml, respectively, per unit size of 10×12 inch.

Washing water was supplied through an electromagnetic valve opened at a period synchronous with processing of the light-sensitive material at a flow rate of 10 l/min (about 1 l/unit size). At the close of the day's work, the electromagnetic valve was automatically opened to drain the washing tank of any remaining water.

Running test was thus performed until both the developing solution and the fixing solution came to have a running equilibrium composition, and then various performance properties of the samples were evaluated.

The results of evaluations are shown in Table 3 below.

TABLE 3

| Sample No. | Emulsion | Compound of (I) Kind | Compound of (I) Amount (mol/mol-Ag) | Sensitivity | Fog | Number of Streaks | Remark |
|---|---|---|---|---|---|---|---|
| 301 | C' | — | — | 100 | 0.150 | 35 | Comparison |
| 302 | D' | — | — | 112 | 0.157 | 41 | " |
| 303 | C' | I-13 | $1.1 \times 10^{-4}$ | 93 | 0.147 | 30 | " |
| 304 | D' | I-13 | " | 105 | 0.155 | 21 | Invention |
| 305 | D' | I-3 | " | 102 | 0.155 | 22 | " |

The results of Table 3 reveal that the light-sensitive materials according to the present invention are superior to the comparative samples in sensitivity-scratch resistance balance.

Thus, it can be seen that the present invention exhibits its effects even when a polyhydroxybenzene compound (chlorohydroquinone) is added to a surface protective layer or when processing conditions are altered.

While the invention has been described in detail and with reference to specific examples thereof, it will be apparent to one skilled in the art that various changes and modifications can be made therein without departing from the spirit and scope thereof.

What is claimed is:

1. A silver halide light-sensitive material comprising a support having on one side thereof at least one negative silver halide emulsion layer containing a binder, in which a coating weight of the total binder on said one side of the support is not more than 4.2 g/$m^2$ and in which silver halide grains in said emulsion layer have been subjected to reduction sensitization and to chemical sensitization in the presence of a nitrogen-containing heterocyclic compound capable of forming a complex with silver wherein said nitrogen-containing heterocyclic compound is a member selected from the group consisting of hydroxytriazaindrene, hydroxytetraazaindene, and hydroxypentaazaindene.

2. A silver halide light-sensitive material as claimed in claim 1, wherein said silver halide grains are tabular grains having an aspect ratio of 3 or more.

3. A silver halide light-sensitive material as claimed in claim 2, wherein said silver halide emulsion layer contains at least one of compounds represented by formula (I):

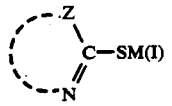

wherein Z represents an atomic group necessary to form a 5- or 6-membered ring; and M represents a hydrogen atom, an alkali metal, or an ammonium group.

4. A silver halide light-sensitive material as claimed in claim 2, wherein said silver halide emulsion layer or other hydrophilic colloidal layer on the support contains a polyhydroxybenzene compound.

5. A silver halide light-sensitive material as claimed in claim 1, wherein said light-sensitive material is an X-ray material.

6. A silver halide light-sensitive material as claimed in claim 1, wherein the total binder on said one side of the support is 2.5 to 4.1 g/$m^2$.

* * * * *